US005301744A

United States Patent [19]

Derks

[11] Patent Number: 5,301,744

[45] Date of Patent: Apr. 12, 1994

[54] MODULAR AIR CONDITIONING SYSTEM

[75] Inventor: Irvin L. Derks, Bryan, Ohio

[73] Assignee: Bard Manufacturing Company, Bryan, Ohio

[21] Appl. No.: 16,153

[22] Filed: Feb. 5, 1993

[51] Int. Cl.[5] ..... F25B 29/00

[52] U.S. Cl. ..... 165/16; 165/21; 165/59; 165/137

[58] Field of Search ..... 165/16, 21, 48.1, 59, 165/137

[56] References Cited

U.S. PATENT DOCUMENTS

| | | | |
|---|---|---|---|
| 2,938,712 | 5/1960 | Pellmyr | 165/137 |
| 3,618,659 | 11/1971 | Rawai | 165/16 X |
| 4,113,004 | 9/1978 | Rush et al. | 165/59 X |
| 4,537,035 | 8/1985 | Stiles | 165/16 X |
| 4,987,952 | 1/1991 | Beal et al. | 165/16 |

*Primary Examiner*—John Rivell

*Attorney, Agent, or Firm*—Willian Brinks Hofer Gilson & Lione

[57] ABSTRACT

An air conditioning system is disclosed which is capable of receiving interchangeable ventilation modules having varying degrees of air mixing abilities. A ventilation module fits inside the air conditioning system and connects to a return air opening, an exhaust duct, an inlet air opening, and a supply air duct for proper routing of air to be conditioned. As ventilation needs change, a different module with appropriate ventilation characteristics can replace the existing module while keeping intact all other components of the air conditioning system such as blowers, compressors, heaters, condensing coils and the like. Ventilation module functionality ranges from an economizer module which allows 100% outside air into a structure, to a motorized air damper module which can be controlled based on various factors such as room occupancy to provide a limited range of fresh and return air mixing, to a blank-off plate which completely prevents use of outdoor air thus leaving the system to condition return air only for supply to the structure. A ventilation module for efficient and economical system operation capable of energy transfer between incoming air and exhausted stale air from the structure is also provided.

23 Claims, 20 Drawing Sheets

MODULAR AIR CONDITIONING SYSTEM

FIELD OF THE INVENTION

This invention relates to air conditioning systems. More particularly, this invention relates to air conditioning systems and the like which combine outdoor air with indoor air, perhaps condition it, and circulate it within a structure.

BACKGROUND OF THE INVENTION

With the increased emphasis on energy conservation over the last 20 years, buildings are being constructed with more insulation and tighter construction techniques, thus reducing natural ventilation to the building. This decrease in natural ventilation has resulted in less fresh air for occupants of a building leading to what is called "sick building syndrome". In response to this problem, building standards have been changed to require controlled ventilation in adequate amounts to insure good "indoor air quality", a phrase which has recently become quite a buzz word in the heating, cooling and ventilation industry. An example of this change is in ASHRAE Standard 62-89 which has increased the ventilation requirements for schools to 15 CFM per student. Most standards previously called for 5 CFM per student. This has caused a large increase in a structure's air conditioning load thus requiring larger, noisier and more expensive systems at significantly higher operating costs. In certain climatic regions, this also increases the latent (moisture removal) load of the building beyond the capability of conventional air conditioning systems resulting in very high and uncontrolled humidity inside the building.

Prior air conditioning and heating systems employed different methods of varying sophistication to control the air which is conditioned and circulated within a structure. The control means used often depends on the type of structure for which ventilation is required as well as structure location. Temperature, humidity, and minimum outside air are three typical quantities which need be controlled. As previously mentioned, state statutes, building codes, ASHRAE standards, and the like often require that schools and other buildings provide minimum amounts of outside air. These facilities must use a heating and cooling system which can meet the necessary requirements. Frequently, a structure will require increased or decreased amounts of outdoor air when its use changes. A new or completely retrofitted air conditioning system is then required to meet those new requirements.

As an example, portable classrooms have become popular in some parts of the United States where enrollment size shifts to various locations within a district. To meet the space requirements needed for such an enrollment flux, portable classrooms are moved from location to location. The ventilation unit attached to the portable classroom may be inadequate for the environmental conditions in the new location, thus requiring either a new ventilation system or a complete retrofit of the old system. A new air conditioning system or retrofit can be expensive. For example, as codes and standards for indoor air quality change, a ventilation system must either be retrofitted or replaced to meet the new requirements.

Present systems cannot be easily retrofitted with a new air conditioning system and do not have modular ventilation units which are easily interchangeable. Methods or systems which can readily adapt to a structure's changed needs do not exist. Further, no systems are available which provide a heat recovery device as a built-in item in an air conditioner, heat pump or gas/electric type wall mounted heating and cooling system.

SUMMARY OF THE INVENTION

The present invention provides a modular air conditioning system capable of changing to meet the needs of its environment or desired use. The invention contains a space capable of receiving ventilation unit modules which are interchangeable depending on a structures's needs. These units connect directly to the heat pump, air conditioner or other air handling system. The ventilation units range in function from a blank off plate (to prevent use of outdoor air) to an economizer (which can proportion outdoor air use from 0% to 100% of maximum). Other modules include a barometric fresh air damper module which opens during blower operations to provide fresh air to be mixed with the conditioned air, a motorized fresh air damper module which provides a higher degree of control in mixing fresh air with the return air, a commercial room ventilator which provides outdoor air intake (within a range of 0% to 100% of maximum) while also providing exhaust capabilities, and an energy transfer module capable of transferring energy between incoming ventilation air and outgoing exhaust air from the structure. The energy transfer module reduces applied operating cost or power of the air conditioning system while improving comfort by controlling adequate humidity levels. The energy transfer module also provides improved indoor air quality with minimum increase in operating cost and without increasing the air conditioning or heating system size. Additionally, exhaust air from the structure is routed past an outdoor heat exchanger coil transferring energy between the two. This transfer, which enhances system performance, cannot be obtained from "stand alone" energy recovery devices, nor would it be realized if the exhaust air is routed in a different manner and not able to pass over the outdoor heat exchanger coil.

The ventilation modules of the present invention allow an air conditioning system to be used for a wide range of applications, such as modular offices, school modernization, telecommunication structures, portable classrooms, correctional facilities and apartments. The ventilation module for a particular application can be installed in the factory, in the field at the time of system installation, or as a retrofit after system installation. The modules are installed within the air conditioning system thus eliminating the need for unsightly hoods or damper assemblies on the exterior of the air conditioning system. As in most heating, ventilation, and air conditioning (HVAC) systems, temperature-dependent functions are controlled by one or more remote thermostats.

It is an object of this invention to provide an air conditioning system capable of changing to meet a structure's specific ventilation requirements.

More particularly, it is an object of the invention to provide an air conditioning system designed to accept modules of varying ventilation capabilities.

A further objective is to provide an air conditioning system with a range of interchangeable ventilation modules which provide various ventilation options from 100% outdoor air to little or no outdoor air and only conditioned return air from the structure.

It is a further object to provide an air conditioning system which can be quickly and easily retrofitted with a new ventilation module for changed ventilation needs.

Still another objective of the invention is to provide an air conditioning system capable of installation on the exterior or interior wall of a structure which occupies little space and has no exterior mounted hood or damper assembly on the system.

Another objective is to provide an air conditioning system able to receive ventilation modules having a varying range of air mixing capabilities based on air temperature and humidity or other parameters.

A further objective is to provide an air conditioning system with a removable energy transfer module which improves indoor comfort and conserves energy.

Yet another objective is to provide an air conditioning system capable of transferring energy between the exhaust air stream and an outdoor heat exchanger coil.

DETAILED DESCRIPTION OF THE PREFERRED EMBODIMENT

Figure 1:
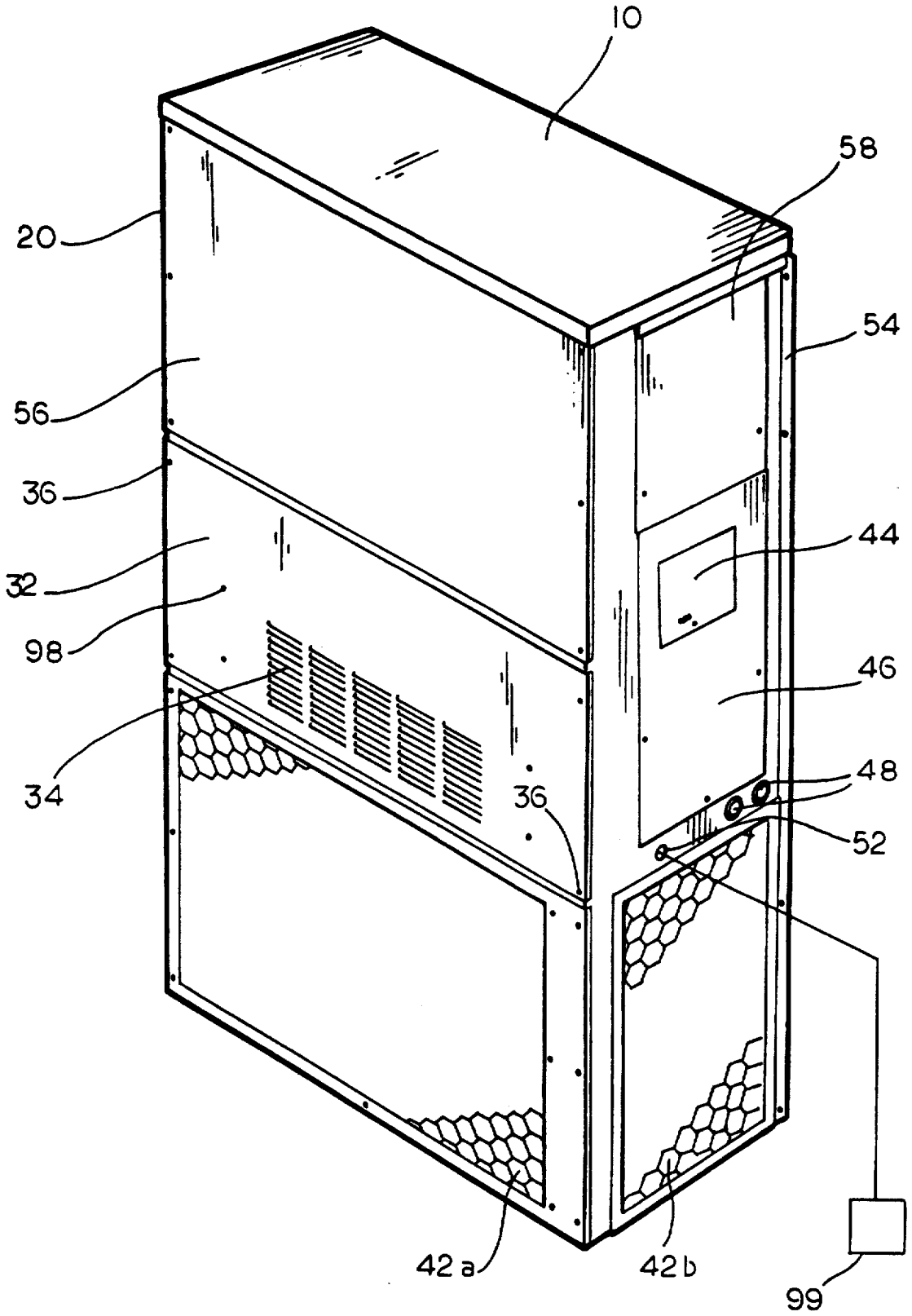
FIG. 1 is an elevational view of a preferred embodiment of the air conditioning system of the present invention from a view outdoor of the structure to which the system would be attached.
Figure 16:
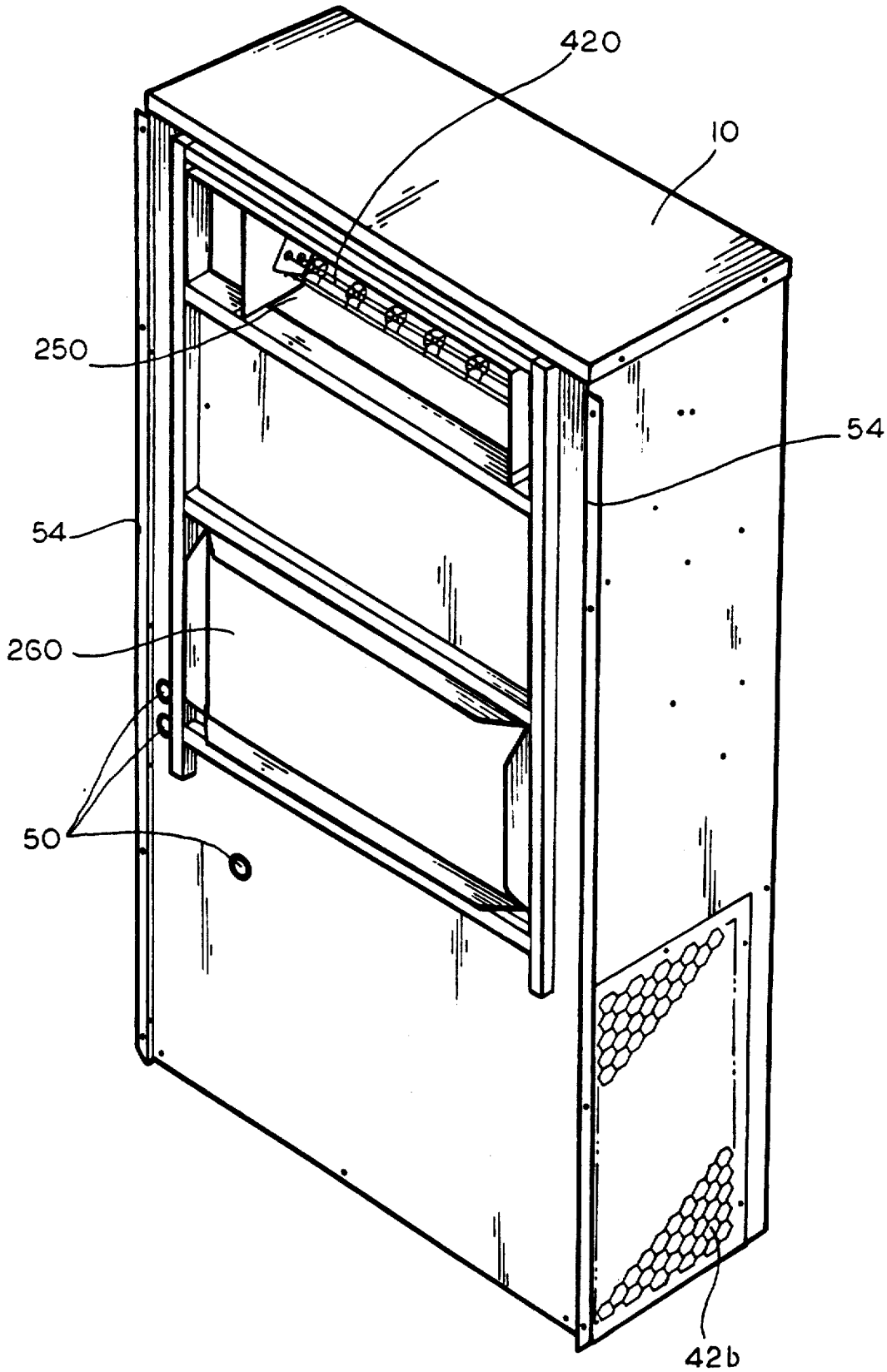
FIG. 16 is an elevational view of the ventilation system from a perspective indoor of the structure to which the system would be attached.

FIG. 1 shows the air conditioning system 10 as seen if mounted on the exterior of a structure (not shown). It can also be attached to the inside of a structure. The air conditioning system 10 is encased in a cabinet 20 made of any durable material, preferably of galvanized twenty-gauge zinc coated steel. A louvered or slotted door 32 allows internal access to the air conditioning system 10 for maintenance, such as changing filters. Door 32 has horizontal slots 34 for fresh air intake and may be completely removed by unscrewing fasteners 36 when changing ventilation modules. A lockable circuit breaker access panel 44 is provided on a side of the air conditioning system 10. Panel 46 affords access to internal electrical components and connections. System power is provided through electrical entrances 48 and low voltage electrical entrance 52. Alternate electrical entrance locations 50 are also provided (which may accommodate existing or new electrical lines carrying signals from the thermostat). See FIG. 16. Vertical mounting brackets 54 along the length of air conditioning system 10 attach it to the subject structure (not shown). Brackets 54 can be located elsewhere on cabinet 20 so that air conditioning system 10 can be mounted at various locations on a structure, including but not limited to, an inside location. Panel 56 covers the area in air conditioning system 10 which contains the indoor heat exchanger coil, the air circulating blowers, and the air supply duct. Perforated metal outlet grill **42*a* allows an exit for exhaust air from the structure while perforated metal inlet grill 42*b* allows intake of outside air to blow across the outdoor heat exchanger coil 544. Heater access panel 58 provides access to electrical heating strips elements 460. See FIG. 19**.

Figure 2:
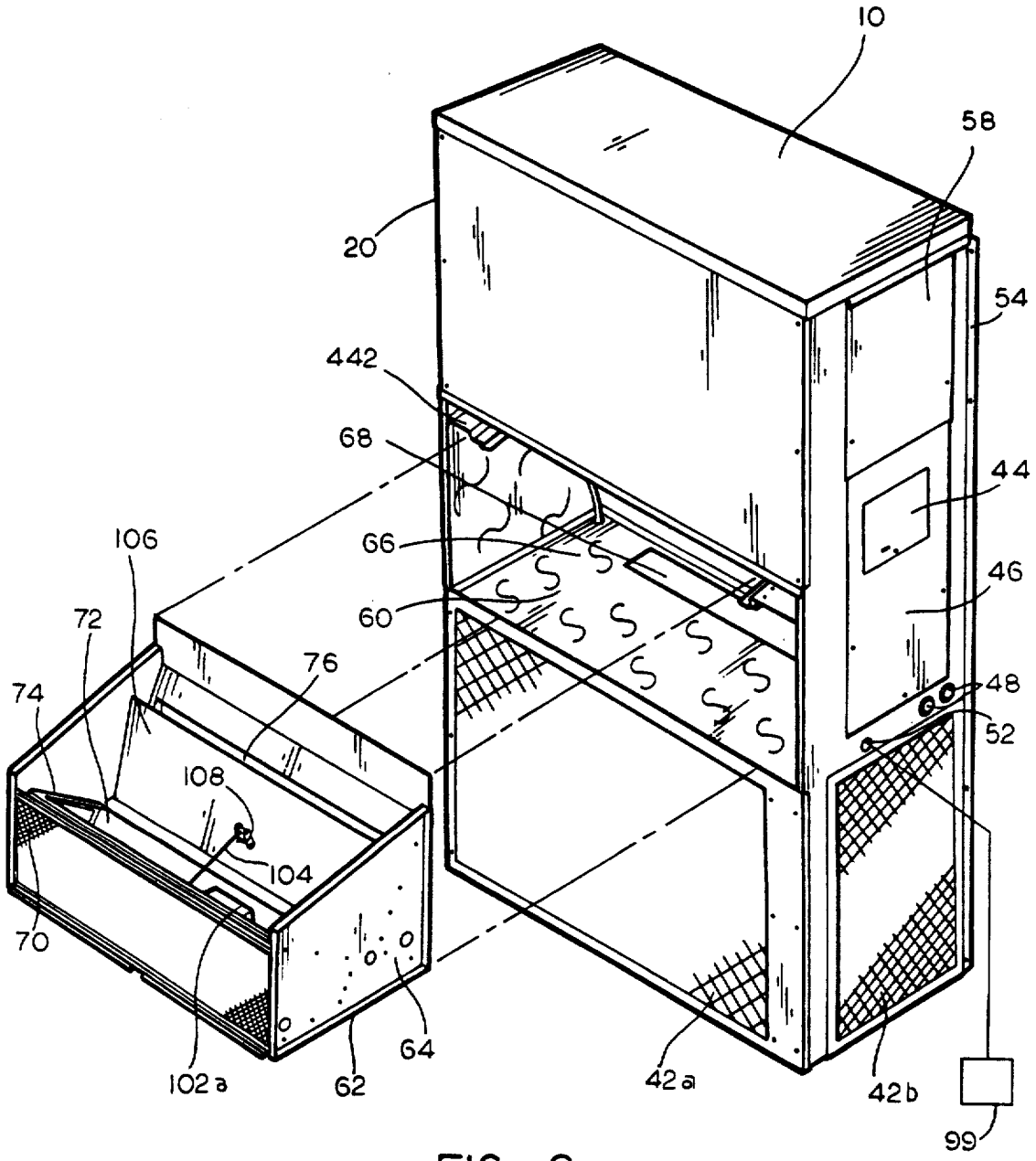
FIG. 2 is an elevational view similar to FIG. 1 and additionally showing the economizer ventilation module as it is installed in the ventilation system.
Figure 5:
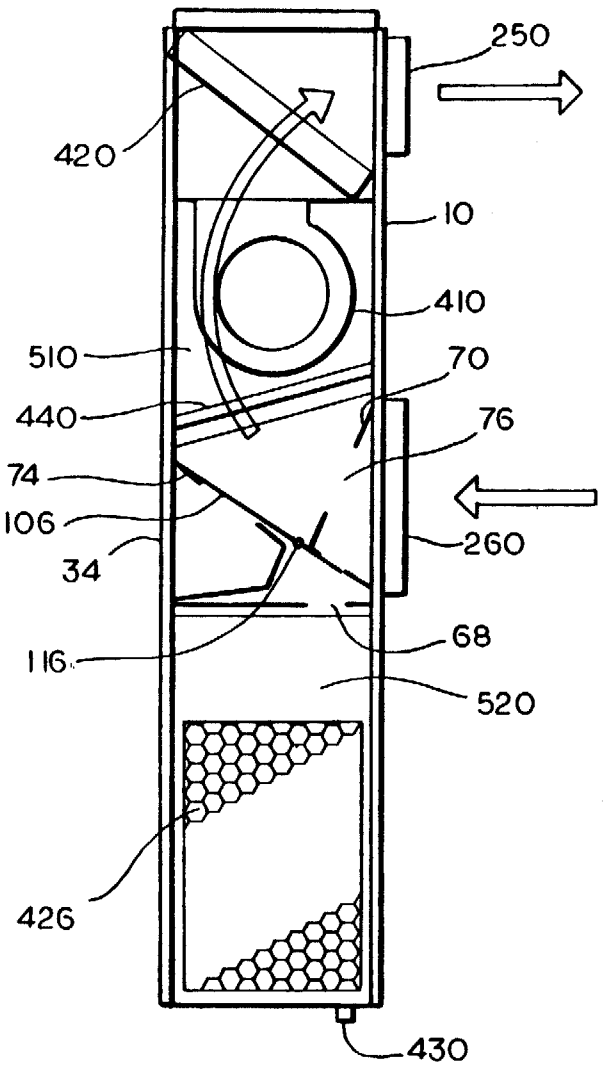
FIG. 5 is a schematic diagram of air flow through the ventilation system with an economizer ventilator module installed operating in mechanical cooling mode.
Figure 4:
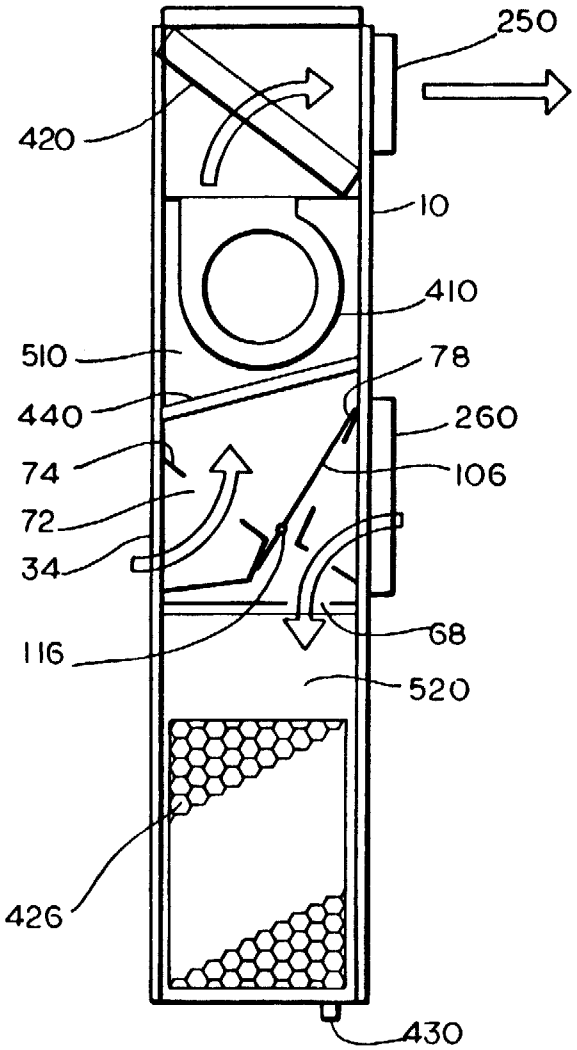
FIG. 4 is a schematic diagram of air flow through the ventilation system with an economizer ventilator module installed operating in economizer mode.

Upon removal of door 32, a chamber 60 exists which is capable of receiving a ventilation module, such as economizer ventilation module 62 as shown in FIG. 2. The module has casing 64 and is made of any durable material, preferably steel. Ventilation module 62 slides into chamber 60 above plane 66 and is attached by screws (not shown). Exhaust opening 68 in plane 66 connects with exhaust duct 520. FIGS. 4 and 5. Ventilation module 62 fits over exhaust opening 68. Air filters 440 are accessed through door 32.

Figure 3:
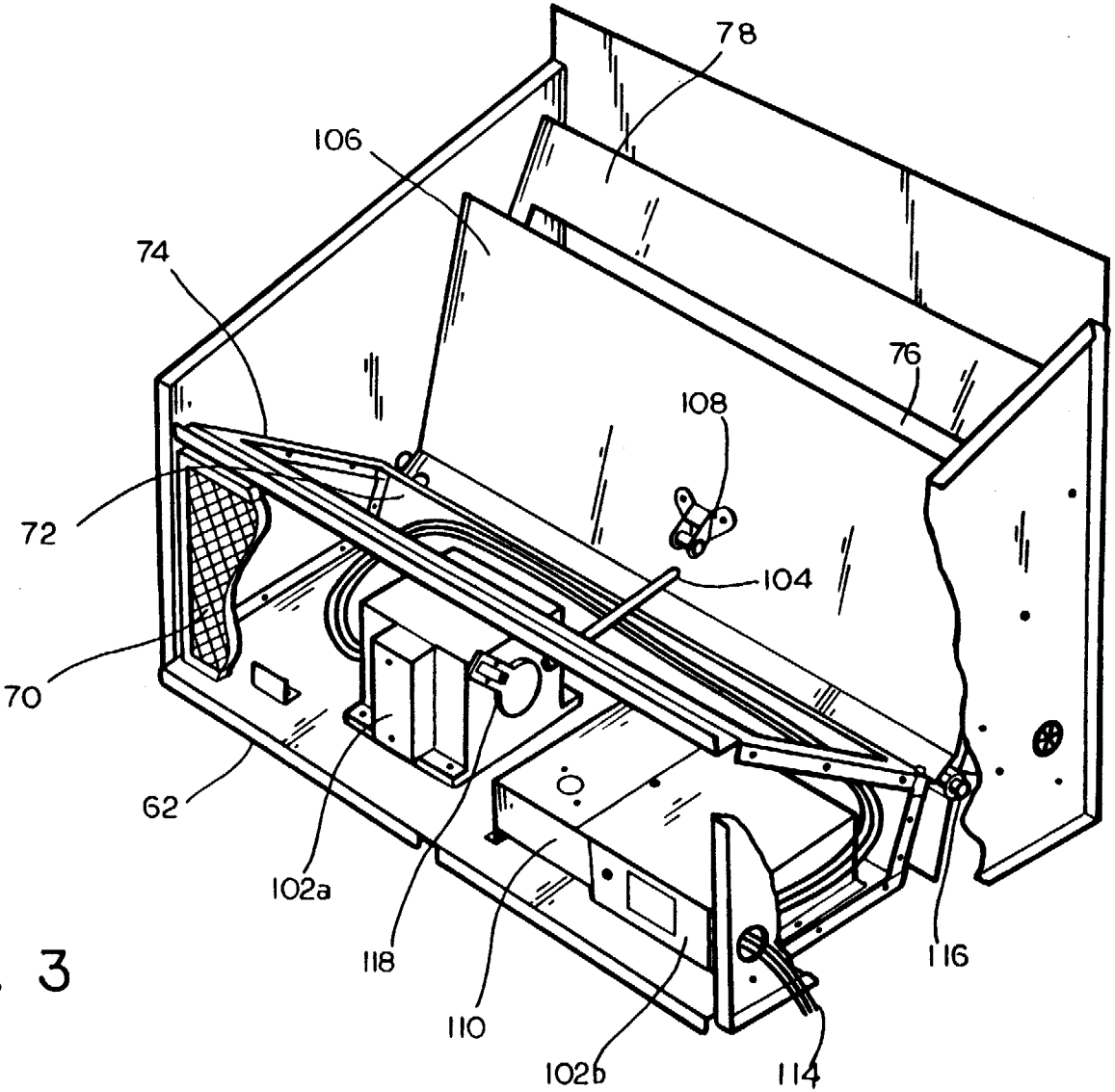
FIG. 3 shows a more detailed view of the economizer ventilation module components.

Economizer module 62 is shown in more detail in FIG. 3. Wires 114 provide electrical power to damper actuator 102*a*. Damper actuator 102*a* turns arm 118 which is connected to blade 106 by rod 104. Pivot joint 108 connects rod 104 with blade 106, which turns on hinge 116. Outdoor air temperature and humidity are sensed by temperature sensing device 110. Damper actuator (which consists of a motor and associated computing electronics) 102*a* processes temperature signals from remote thermostat 99 as well as other air conditioning system 10 parameters such as humidity, enthalpy, minimum blade 106 position, and mixed air sensing for control of blade 106. Electrical relay unit 102*b* contains electrical relays for the economizer unit.

FIG. 4 shows a schematic diagram of airflow through air conditioning system 10 with economizer module 62 installed and operating in economizer mode. In economizer mode, outside air is circulated into the structure thus saving wear on the air cooling compressor and extending its life. Return air is exhausted exteriorly. As outside air is drawn into the air conditioning system 10, it passes through slots 34 in door 32, through module screen 70, through space 72 and into chamber 60 if blade 106 is open. Blade 106 is in the completely open position resting on partition 78. The outside air passes through filter 440 and into air supply duct 510.

Air circulating is accomplished by device 410 in supply air duct 510. Air blowers, preferably twin blowers with multispeed motors, provide airflow adjustments for high and low static operation. Electric heater elements 460 with automatic limit and thermal cut-off safety control are provided for heat conditioning of the supply air.

The conditioned air circulates past indoor heat exchanger coils 420, which preferably are aluminum finned copper coils, and through supply air outlet 250 into the structure's interior. Conditioned supply air enters the structure forcing return air through air return opening 260 where it is routed by blade 106 through exhaust opening 68, into exhaust duct 520, through exhaust outlet grill 42*a* and to the structure's exterior.

In mechanical cooling mode, an option with economizer module 62 installed, no outdoor air is circulated and only indoor return air is routed through air conditioning system 10 as shown in FIG. 5. Blade 106 is in the fully closed position resting on partition 74 thus blocking space 72 and preventing outdoor air from entering the air supply duct 510 and also preventing return air from exiting through exhaust opening 68. Return air enters ventilation system 10 through return air inlet 260, passes through space 76 and is routed through filter 440 and into air supply duct 510. Air circulating is accomplished by device 410. The air then circulates past indoor heat exchanger coil 420 and through supply air outlet 250 into the structure's interior. Indoor heat exchanger coil 420 is drained through drain 430.

Other blade 106 positions allow various percentages of fresh air to be mixed with return air ranging from 0% to 100%. Those positions are based on control signals from a system control unit which can take into account parameters including but not limited to air temperature and humidity.

Figure 6:
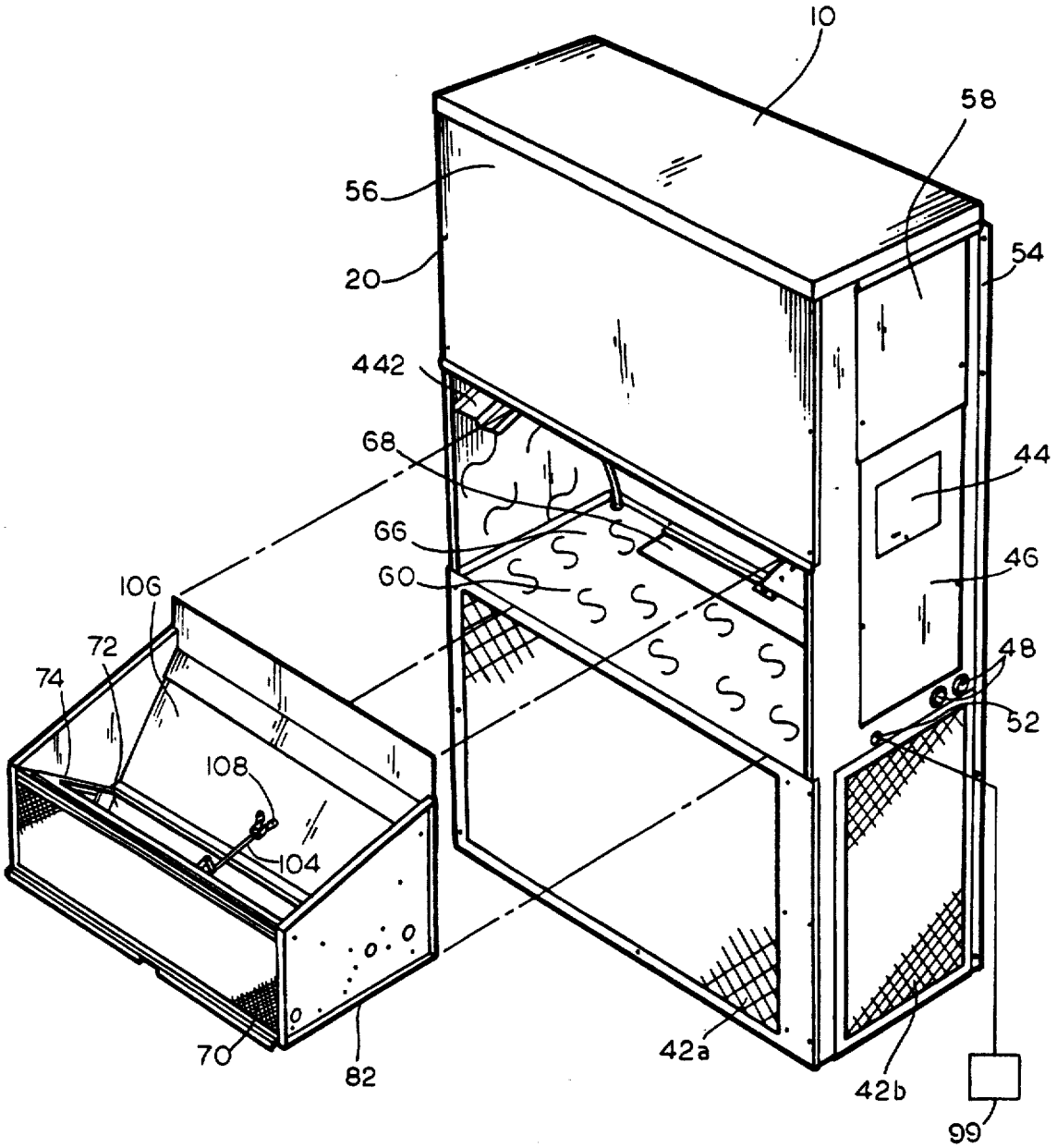
FIG. 6 is an elevational view similar to FIG. 1 and additionally showing the commercial room ventilator module as it is installed into the ventilation system.
Figure 7:
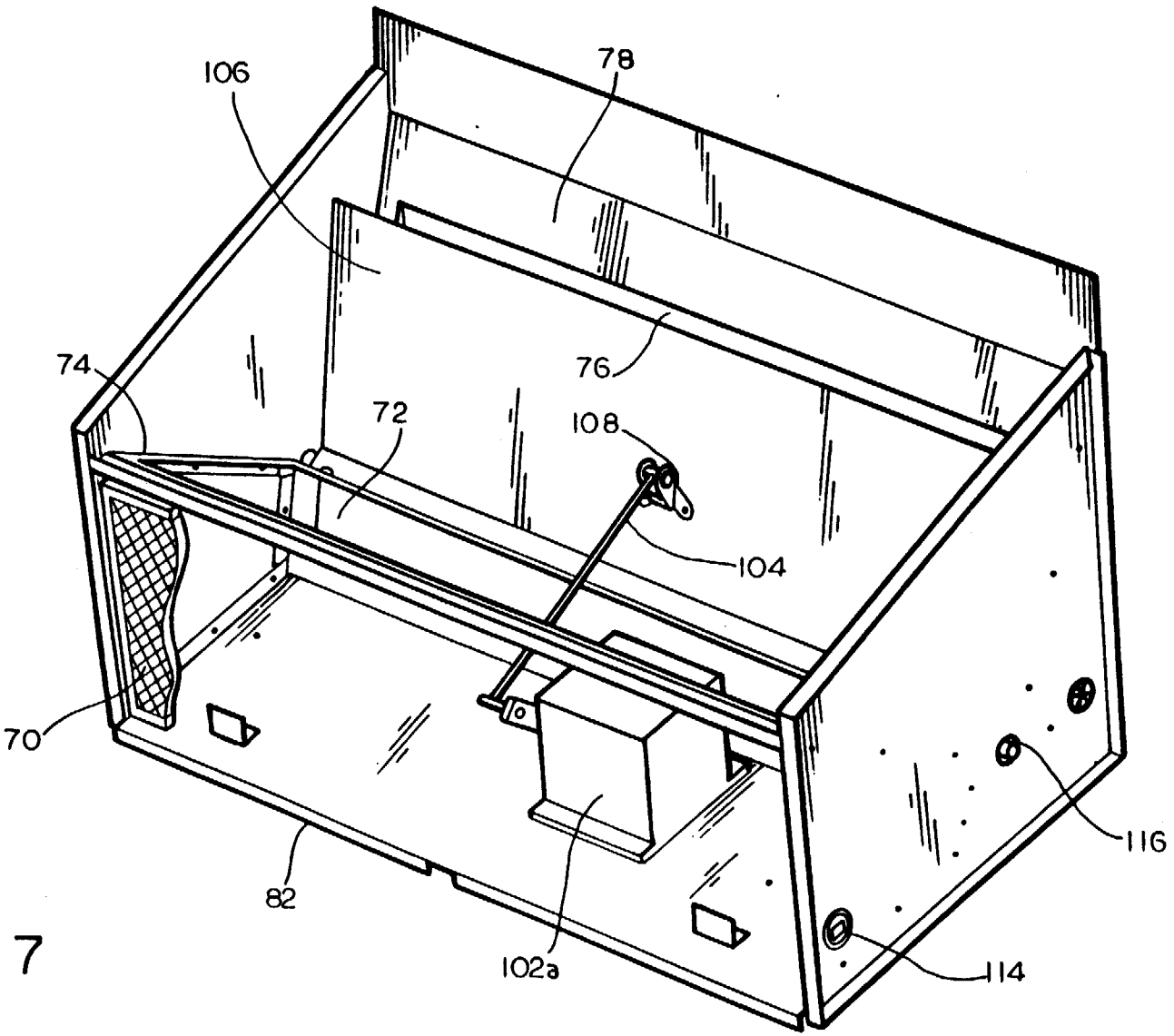
FIG. 7 shows a detailed illustration of the classroom ventilator module components.

FIG. 6 shows commercial room ventilator module 82 as it would be installed into air conditioning system 10. FIG. 7 is a more detailed drawing of the commercial room ventilator module. The module consists of a damper actuator 102*a* which controls blade 106 position. Operation is similar to that of the economizer module except no air temperature sensing capability exists for controlling damper 106. The module provides outside air intake along with exhaust capability. Control of the commercial room ventilator unit can be accomplished with a system control unit such as the Bard CS2000, which features total system control including adjustment of the commercial room ventilator unit based on occupancy, control for maximum heating and cooling settings, and automatic adjustments for vacation or no occupancy conditions. Control can also be accomplished with an electronic programmable thermostat 99 or timer.

Figure 11:
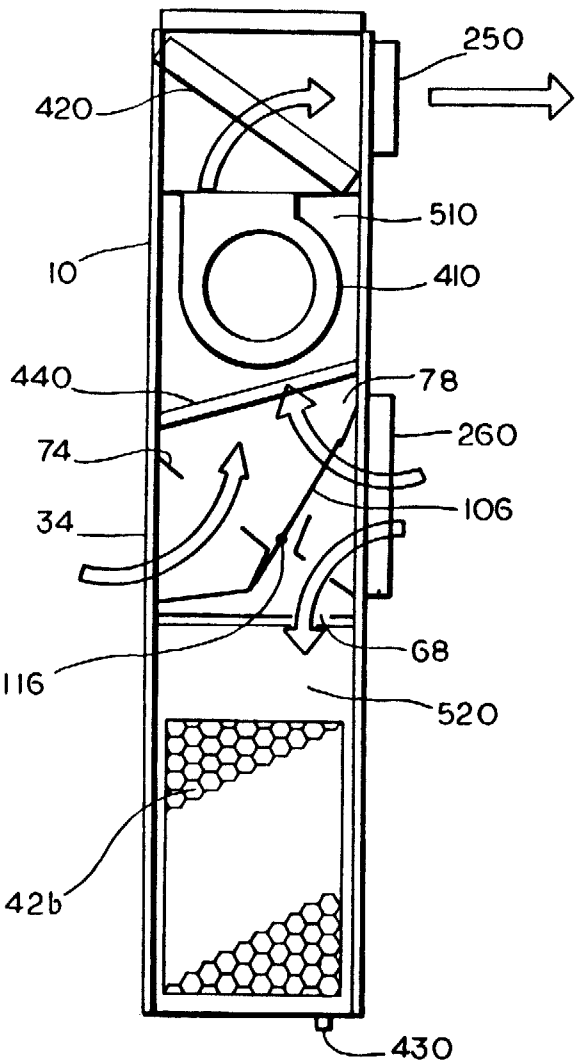
FIG. 11 is a schematic diagram of air flow through the ventilation system with a classroom ventilator module installed.

FIG. 11 is a schematic diagram of airflow through ventilation system 10 with classroom ventilator module 82 installed. Flow is similar to that when an economizer module is installed with preferably a maximum of 75% blade 106 opening with return air as opposed to 100% capability in the economizer module.

Figure 8:
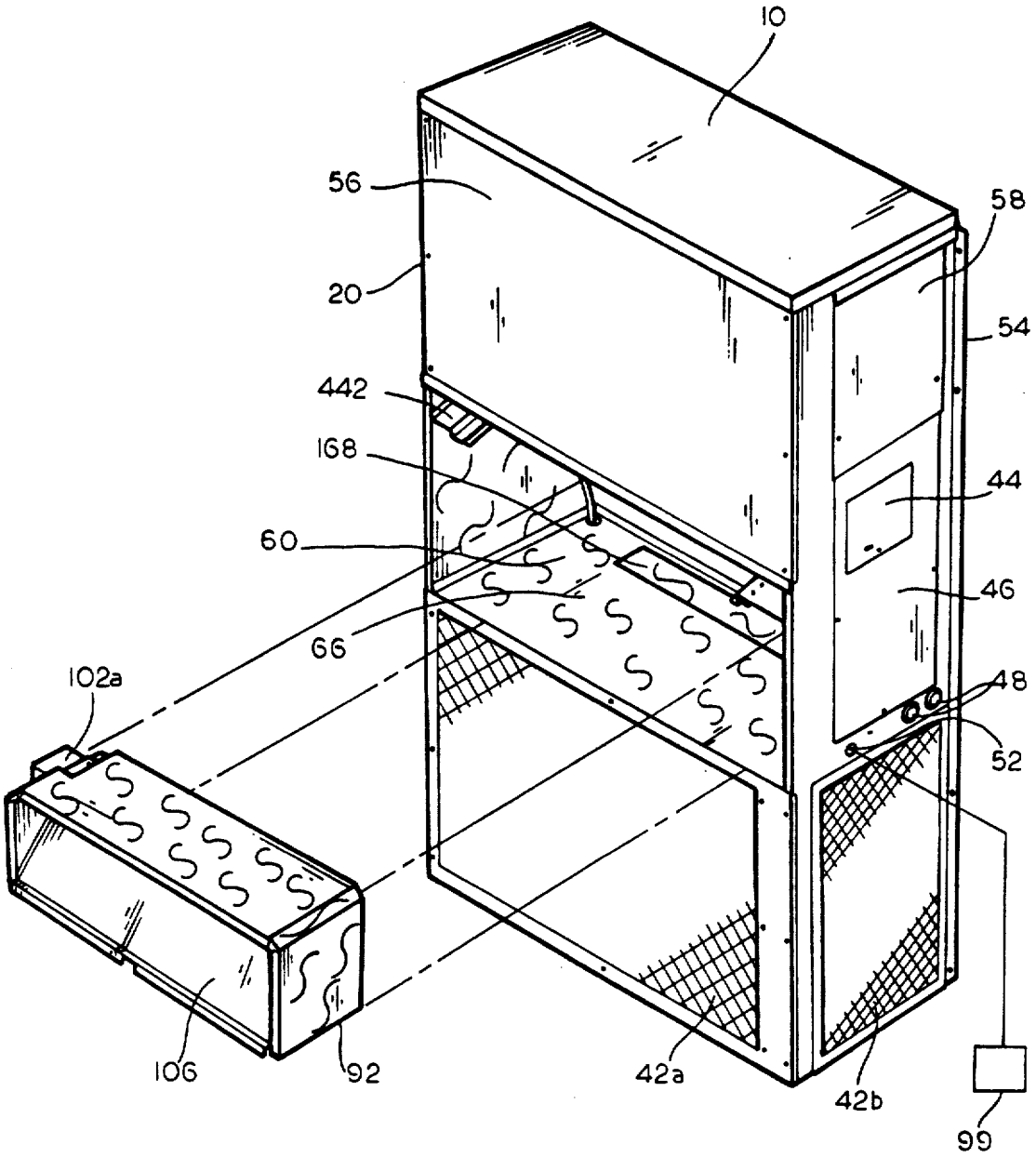
FIG. 8 is an elevational view similar to FIG. 1 and additionally showing the motorized fresh air damper module as it is installed into the ventilation system.

FIG. 8 shows a motorized fresh air damper module 92 as it would be installed into air conditioning system 10. This module replaces interior air lost due to exfiltration out windows, doors and other seepage in the structure. Space 68 is covered with exhaust cover plate 168 to prevent air from exhausting through the air conditioning system 10.

Figure 9:
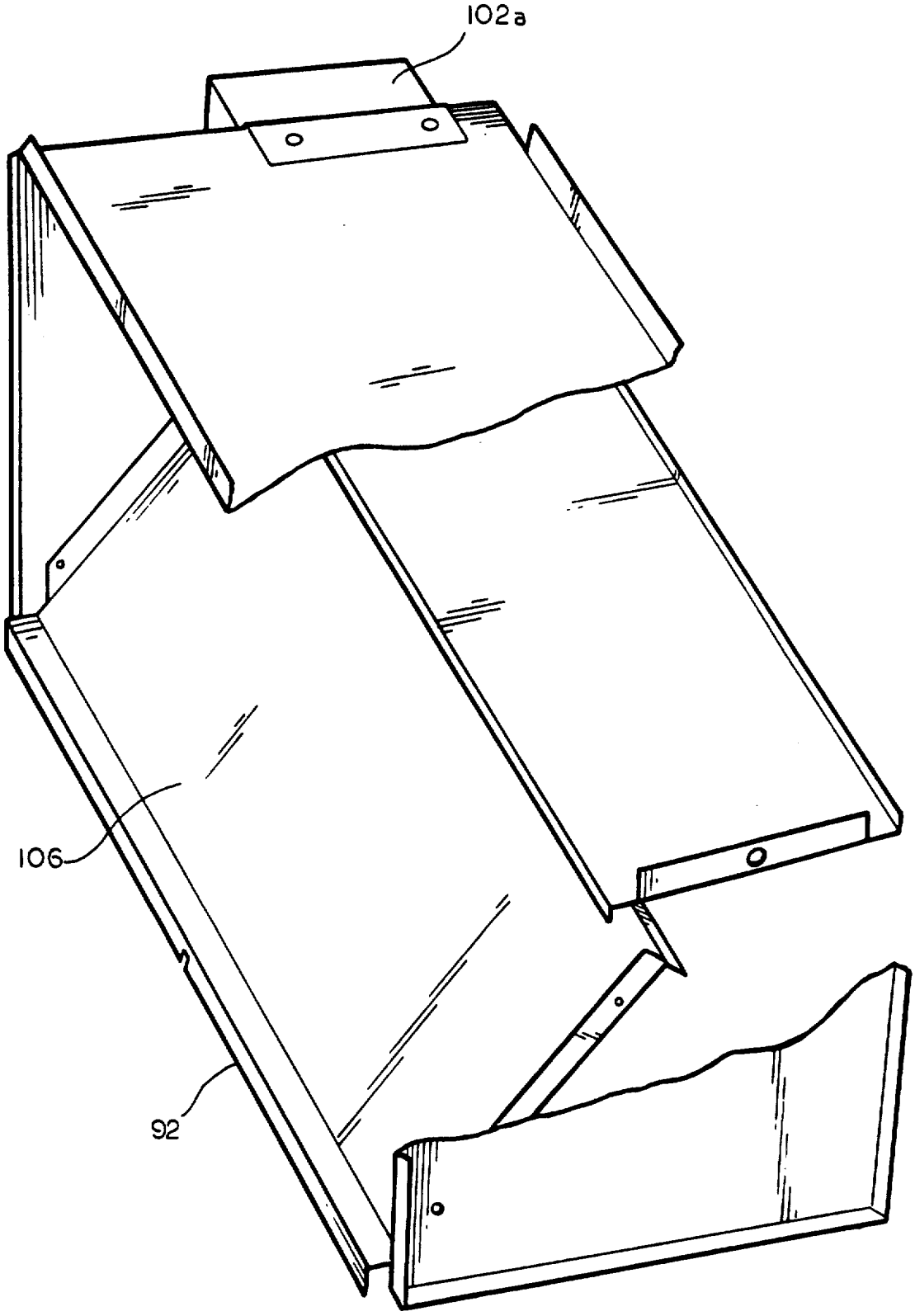
FIG. 9 shows a detailed illustration of the motorized fresh air damper module components.

FIG. 9 is a more detailed drawing of the motorized fresh air damper 92. The module consists of motor 102, damper actuator 102*a* preferably a 24 volt electric motor, and associated computing electronics which controls damper 106 position. The module provides outside air to be mixed with return air, preferably a maximum of 25% fresh air. Damper 106 can be controlled by the air blower circuit or can be controlled based on other factors such as room occupancy or time-of-day.

Figure 10:
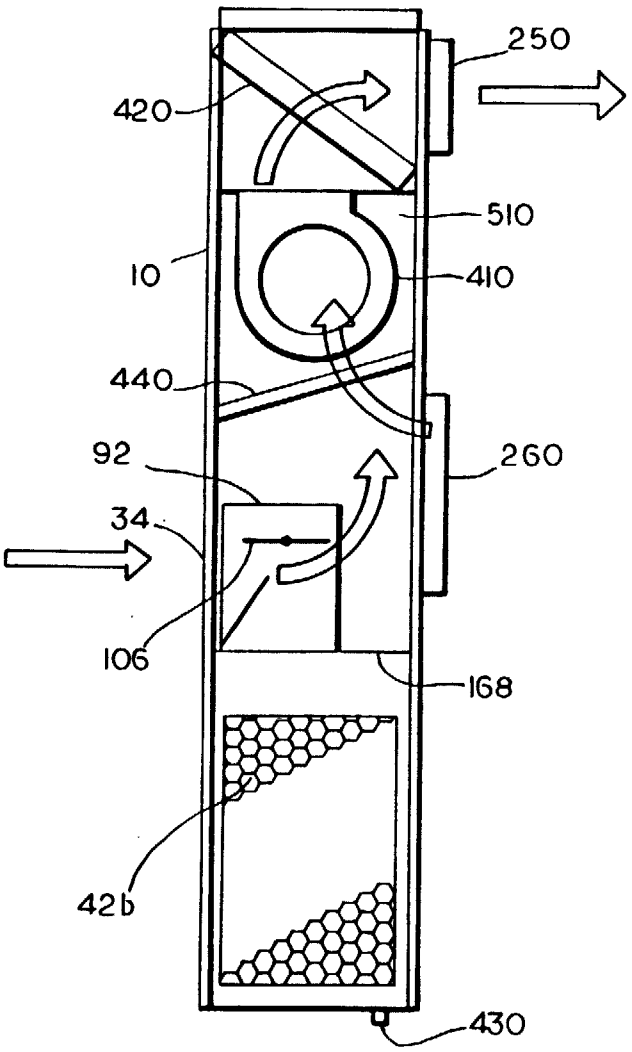
FIG. 10 is a schematic diagram of air flow through the ventilation system with a motorized fresh air damper module installed.

FIG. 10 is a schematic diagram of airflow through air conditioning system 10 with motorized fresh air damper 92 installed. Blade 106 can be either fully open or fully closed. In the fully open position, as shown in FIG. 10, outside fresh air enters ventilation system 10 through slots 34, passes through motorized fresh air damper module 92, into chamber 60 where it mixes with return air from the structure drawn through return air inlet 260. The mixed air then passes through filter 440 and into air supply duct 510. Air circulating is accomplished by device 410. The air then circulates past indoor heat exchanger coil 420 and through supply air outlet 250 into the structure's interior. Indoor heat exchanger coil 420 is drained through drain 430.

Figure 12:
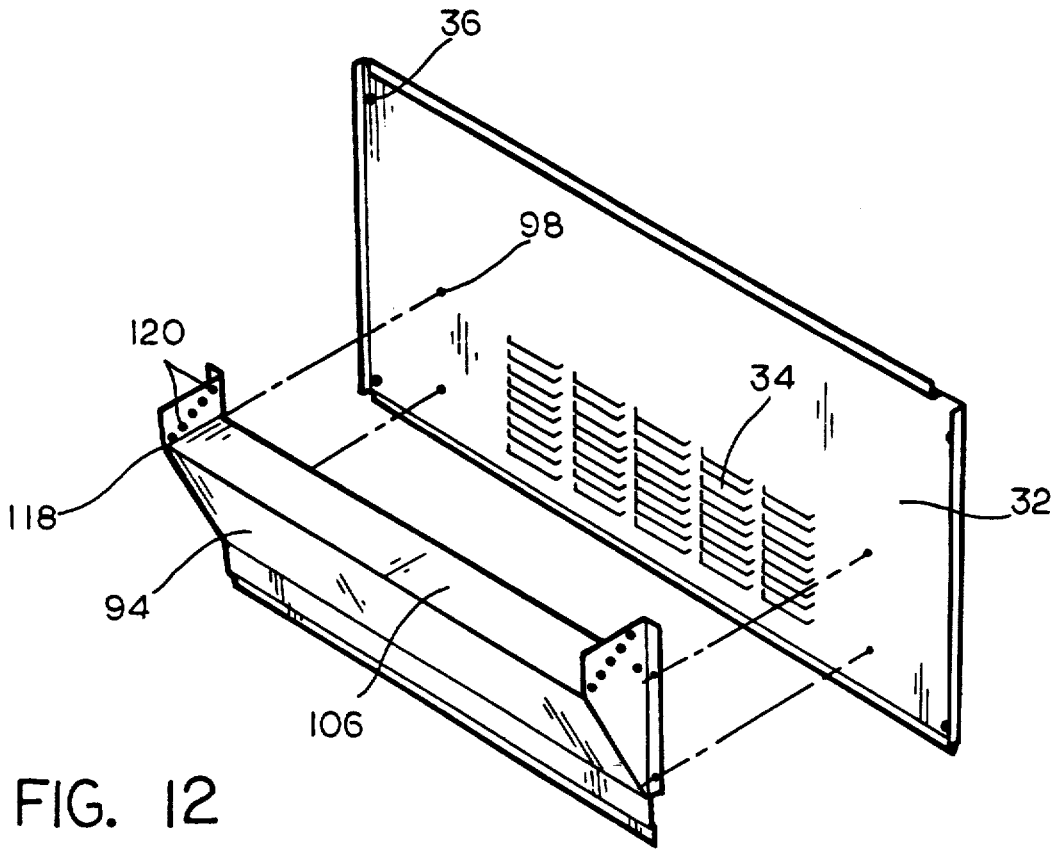
FIG. 12 shows the position of the barometric fresh air damper module as it is fastened onto a louvered front access door which attaches over the ventilation module receptacle space.

A fourth ventilation alternative is shown in FIG. 12. The barometric fresh air damper 94 attaches to the inside of louvered or slotted door 32 by screws 98 thus extending the module into space 60 within air conditioning system 10. Blade 106 opens on hinge 118 during air blower operation due to pressure differential between the top and bottom surfaces of blade 106. Blade 106 closes when the blower is off. Adjustable stops 120 limit the amount of outside air mixed with return air for supply air to the structure, preferably with a maximum of 25% fresh air mixed with the return air.

Figure 15:
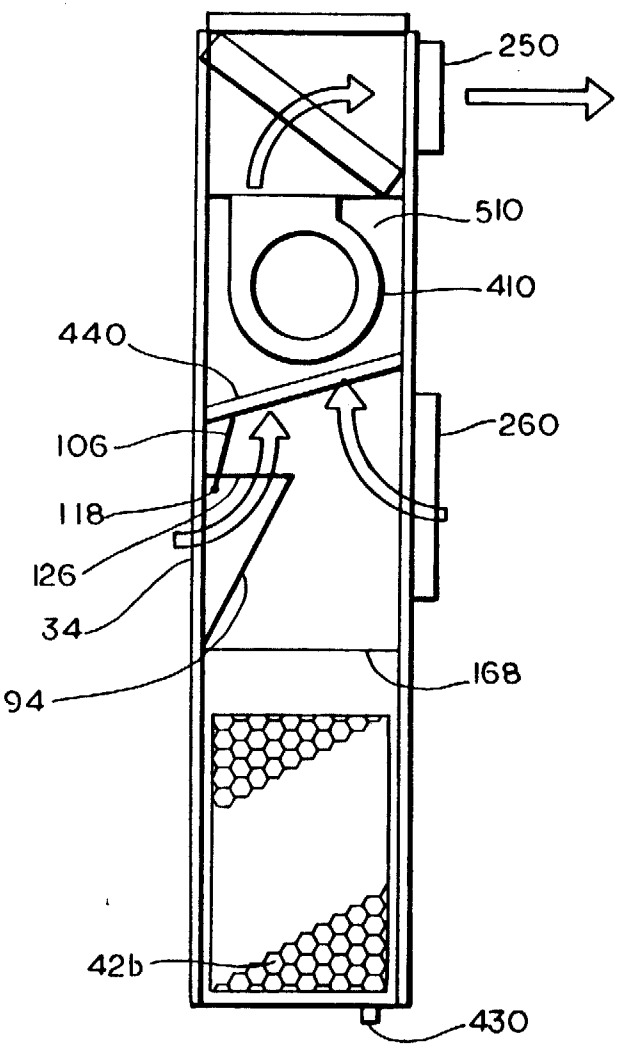
FIG. 15 is a schematic diagram of air flow through the ventilation system with a barometric ventilator module installed.

FIG. 15 depicts airflow through conditioning system 10 with the barometric fresh air damper 94 installed. When the air circulating blower 410 is on, air is drawn through return air inlet 260 thus decreasing the air pressure in space 60. The outside barometric pressure forces blade 106 open allowing fresh air through slots 34, through space 126 and into space 60 where it mixes with return air. The mixed air then passes through filter 440 and into air supply duct 510. Air circulating is accomplished by device 410. The air then circulates past indoor heat exchanger coil 420 and through supply air outlet 250 into the structure's interior.

Figure 13:
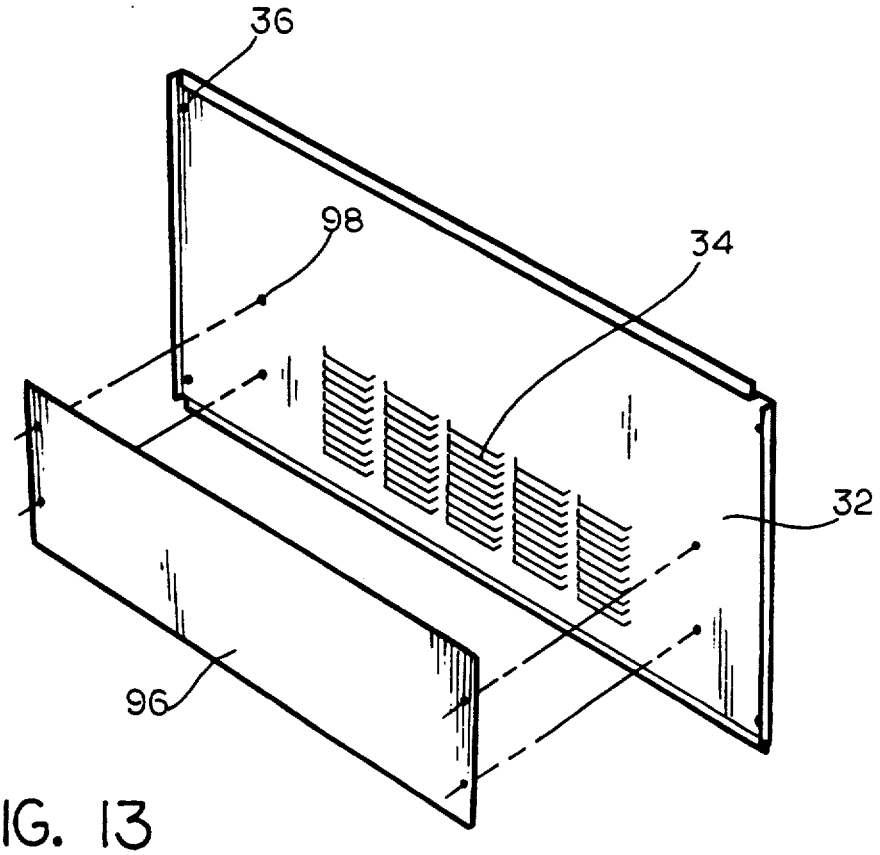
FIG. 13 shows the position of the blank-off plate as it is fastened onto a louvered front access door which attaches over the ventilation module receptacle space.
Figure 14:
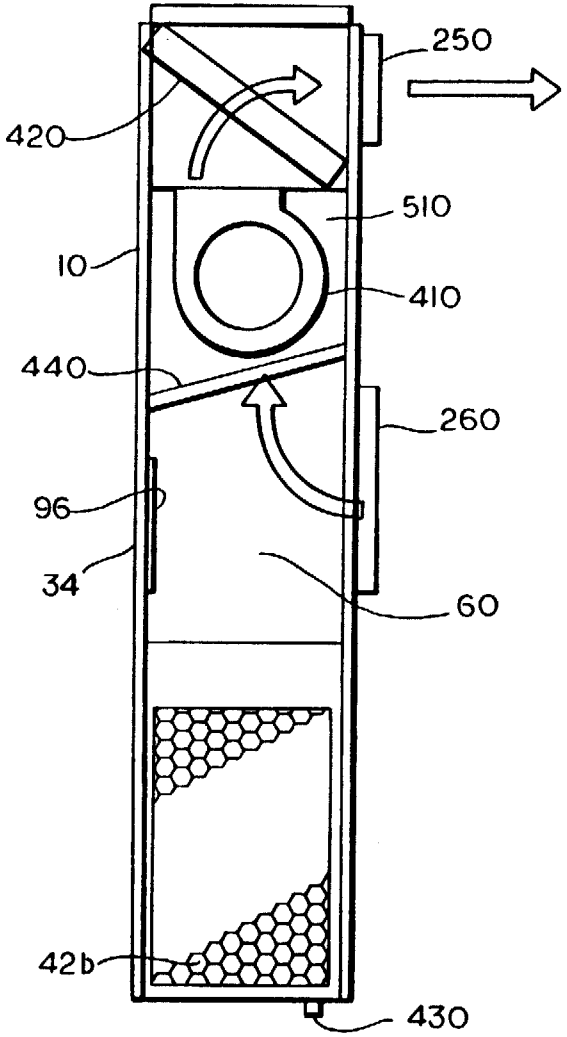
FIG. 14 is a schematic diagram of air flow through the ventilation system with a blank-plate installed.

When no fresh air is required, air conditioning system 10 can be operated without a ventilation module in chamber 60. Blank-off plate 96 is attached to louvered or slotted door 32 by screws 98 to covering slots 34 to make it airtight as shown in FIG. 13. Airflow through ventilation system 10 with blank-off plate 96 installed is shown schematically in FIG. 14. As blower and air conditioner 410 turns on, return air is drawn from the structure's interior through return air opening 260 and into chamber 60. No outside fresh air is drawn into ventilation system 10 as blank-off plate 96 blocks passage through slots 34. The return air then passes through filter 440 and into air supply duct 510. Air circulating is accomplished by device 410. The air then circulates past indoor heat exchanger coil 420 and through supply air outlet 250 into the structure's interior.

Figure 17:
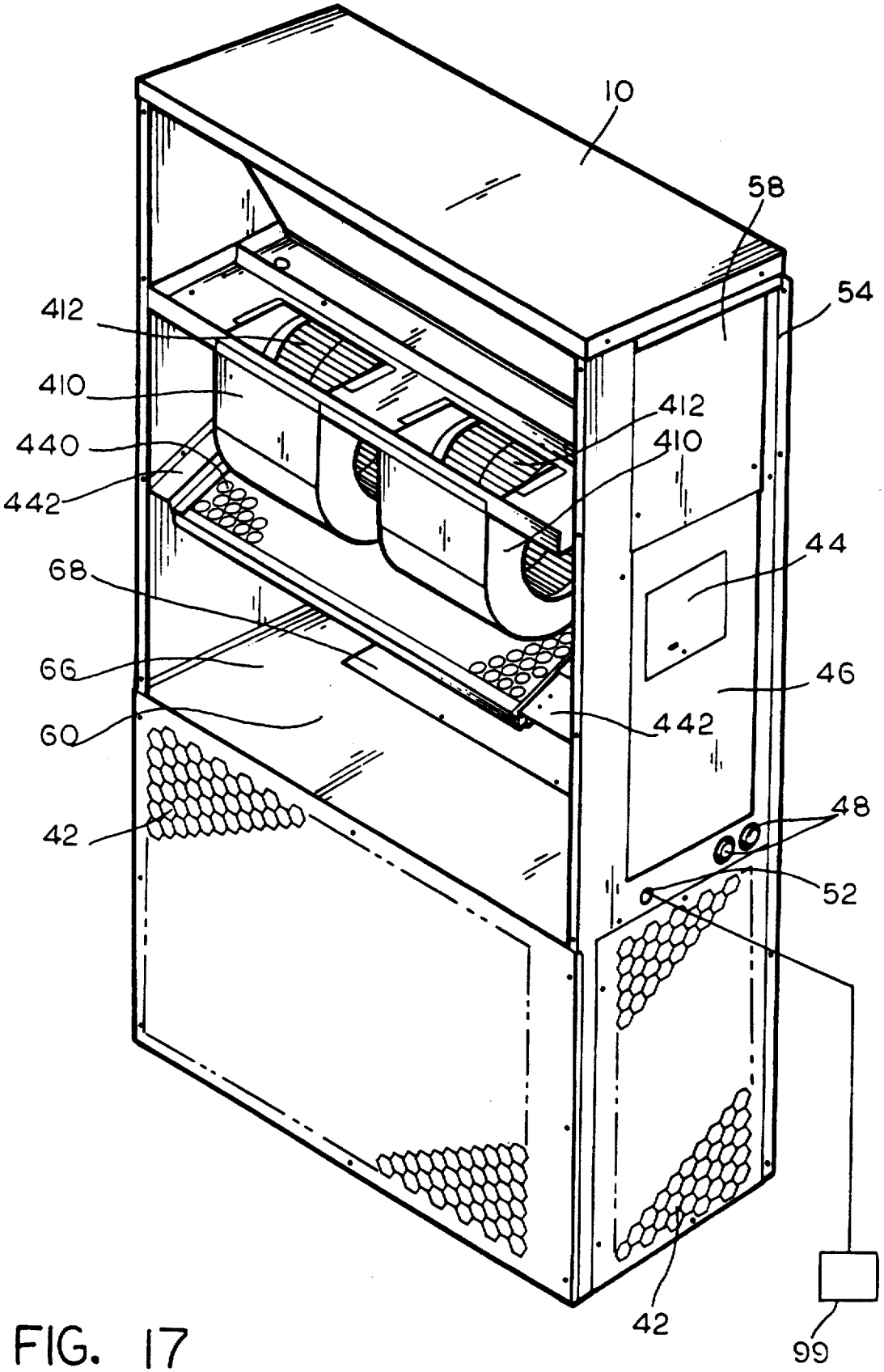
FIG. 17 is an elevational view of the air conditioning system from a perspective outdoor of the structure to which the air conditioning system would be attached shown with access doors removed.

A perspective view of air supply duct 510 in the interior of air conditioning system 10 is shown in FIG. 17. Air filter 440 is slidably mounted on brackets 442 below air circulating devices 410. Rotatable fan wheels 412 circulate air through air supply duct 510.

Figure 18:
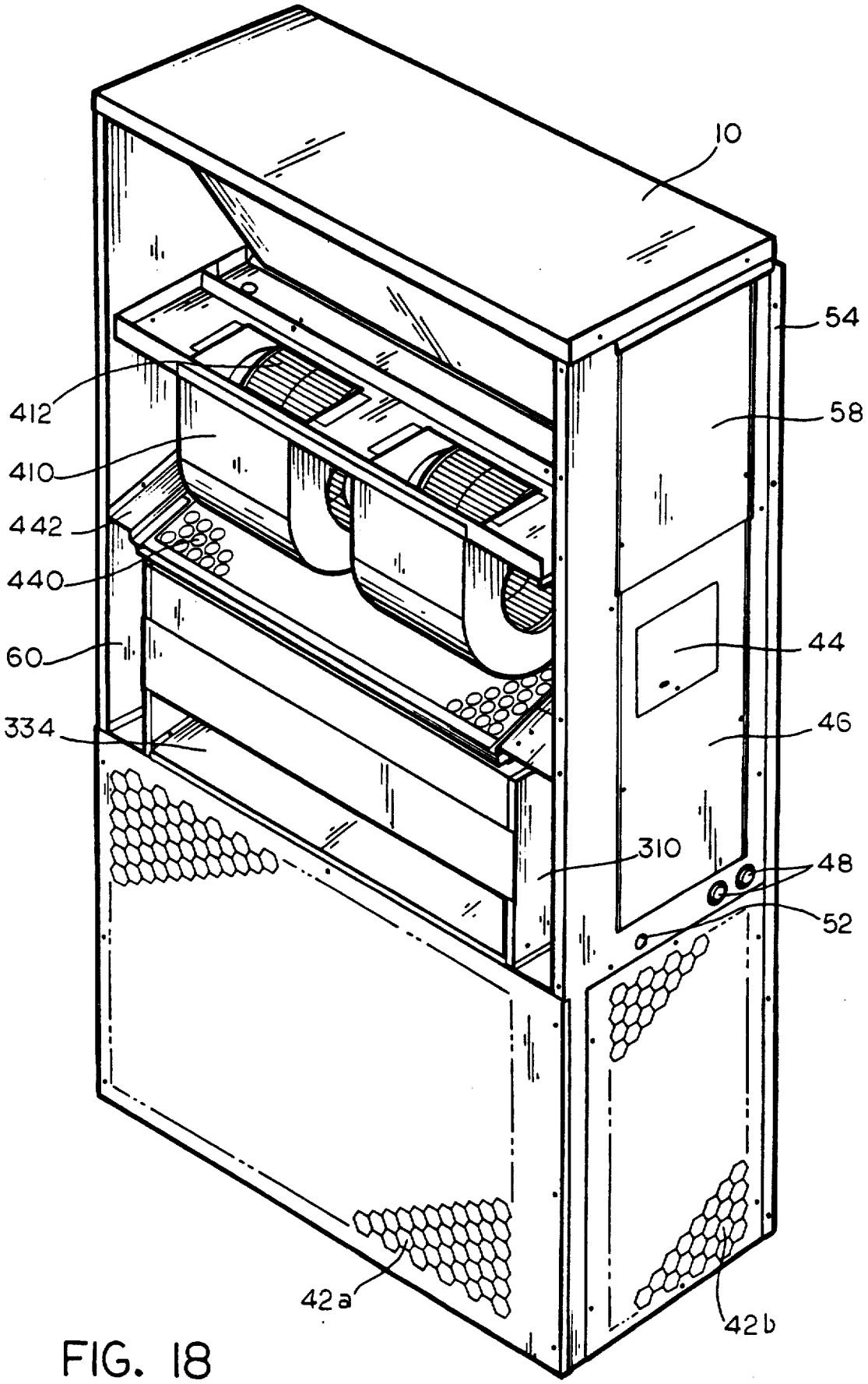
FIG. 18 shows a detailed illustration of the energy transfer module components as it would appear outdoor of the structure as installed in the system.
Figure 19:
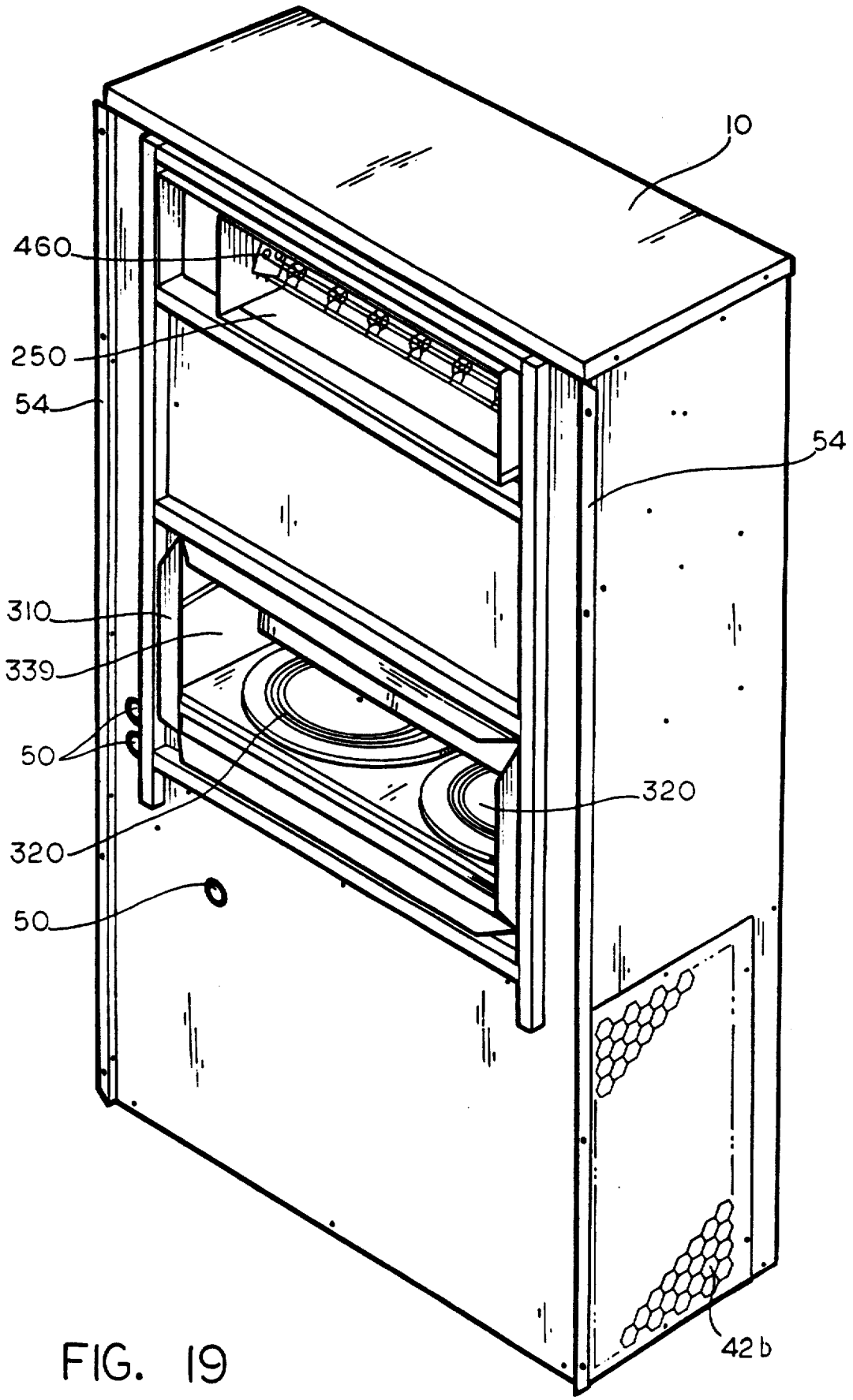
FIG. 19 shows a detailed illustration of the energy transfer module components similar to FIG. 18 but showing it as it would appear looking from the indoor of the structure.
Figure 20:
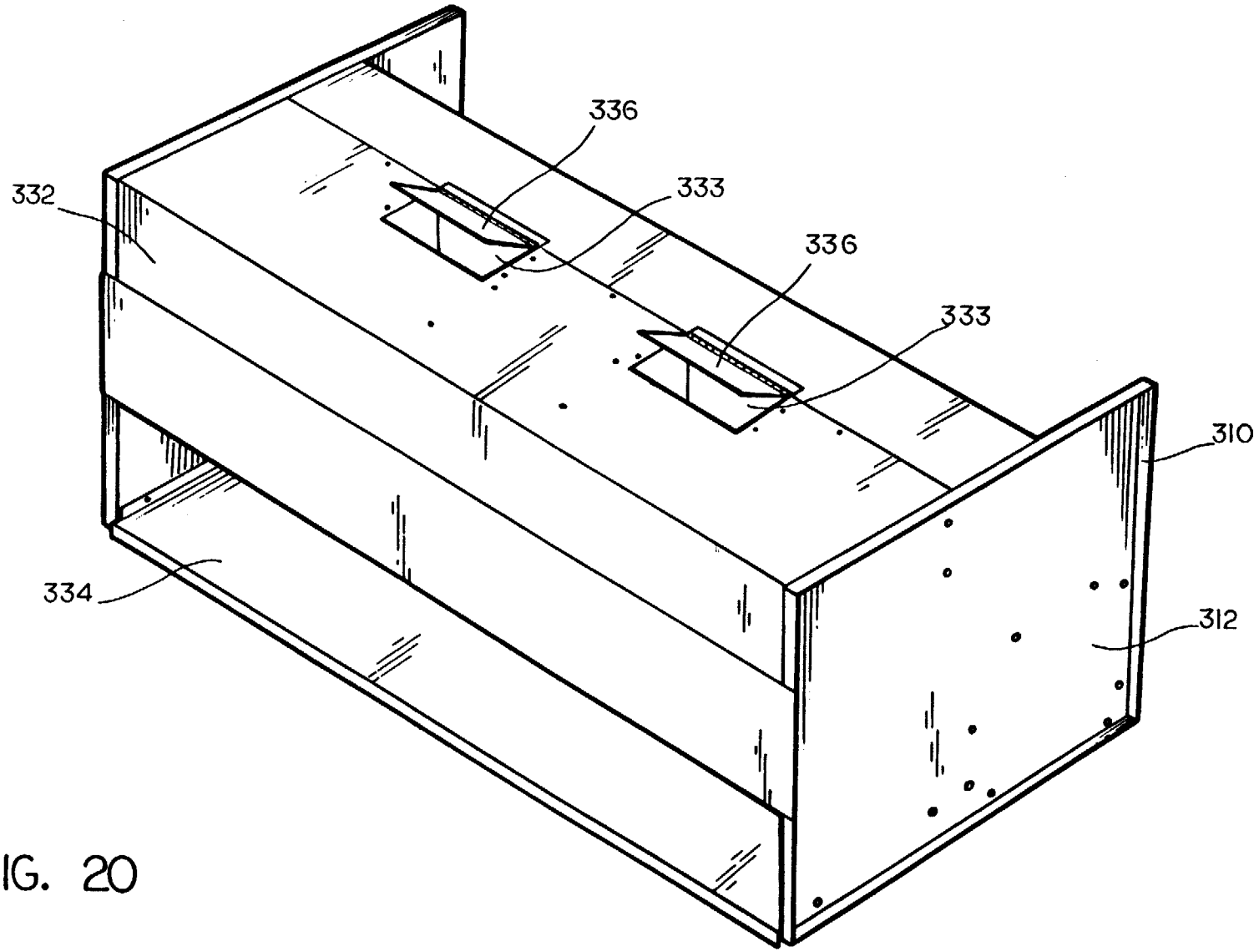
FIG. 20 is an elevational view of the ventilation system similar to FIG. 17 also showing the energy transfer module as installed from a perspective outdoor of the structure to which the system would be attached.
Figure 21:
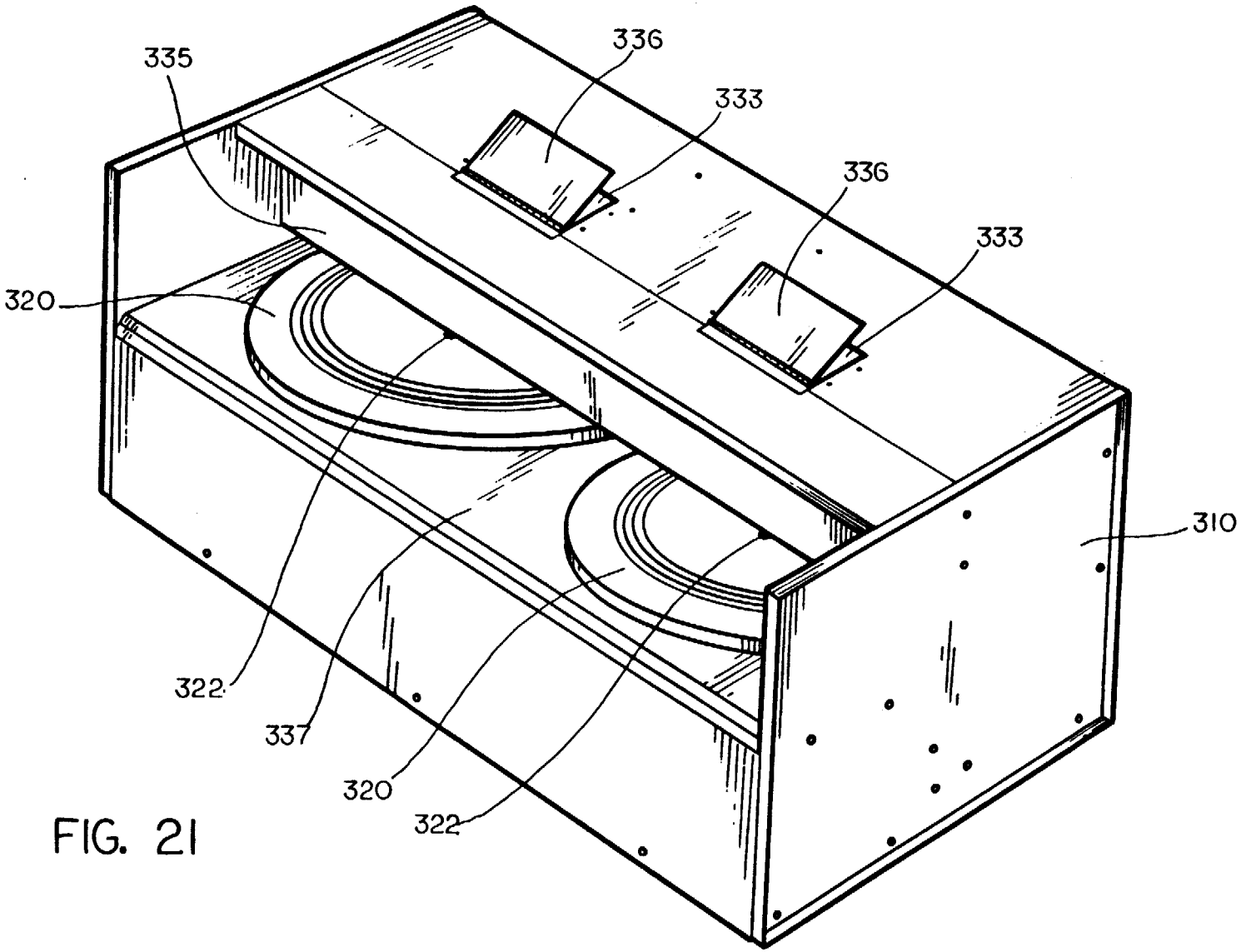
FIG. 21 is an elevational view of the ventilation system similar to FIG. 16 also showing the energy transfer module as installed from a perspective indoor of the structure to which the system would be attached.
Figure 22:
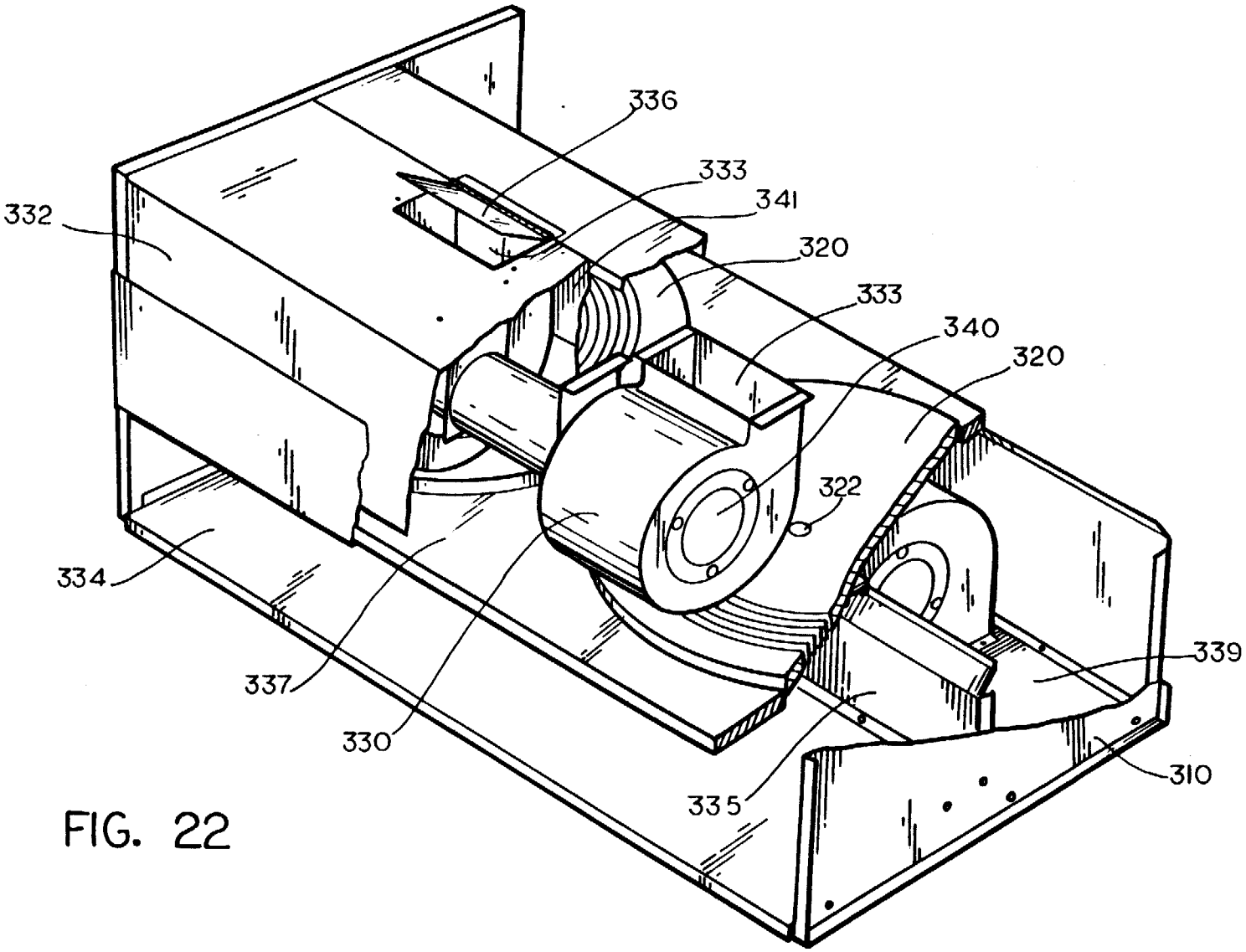
FIG. 22 shows a more detailed cut-away illustration of the energy transfer module components similar to FIG. 18 as it would appear outdoor of the structure as installed in the system.

Energy transfer between incoming and outgoing air streams can be economically accomplished during ventilation when energy transfer module 310 is installed in space 60 of air conditioning system 10 as shown in FIG. 18. FIG. 19 shows an inside view of air conditioning system 10 with energy transfer module 310 installed. FIGS. 20 and 21 show energy transfer module 310 from outside and inside views, respectively. A detailed cutaway view of energy transfer module 310 is shown in FIG. 22. Encased in box 332 are blower housings 330 which have blower wheels (not shown) to draw outside air through intake space 334, through energy transfer disks 320, through blower inlets 340 and force it out through openings 333. The outside air is routed by backdraft dampers 336 into air supply duct 510. A drive motor (not shown) provides the power to rotate the energy transfer disks 320 around center pins 322. Plate 335 prevents outside air from passing into space 339.

Figure 23:
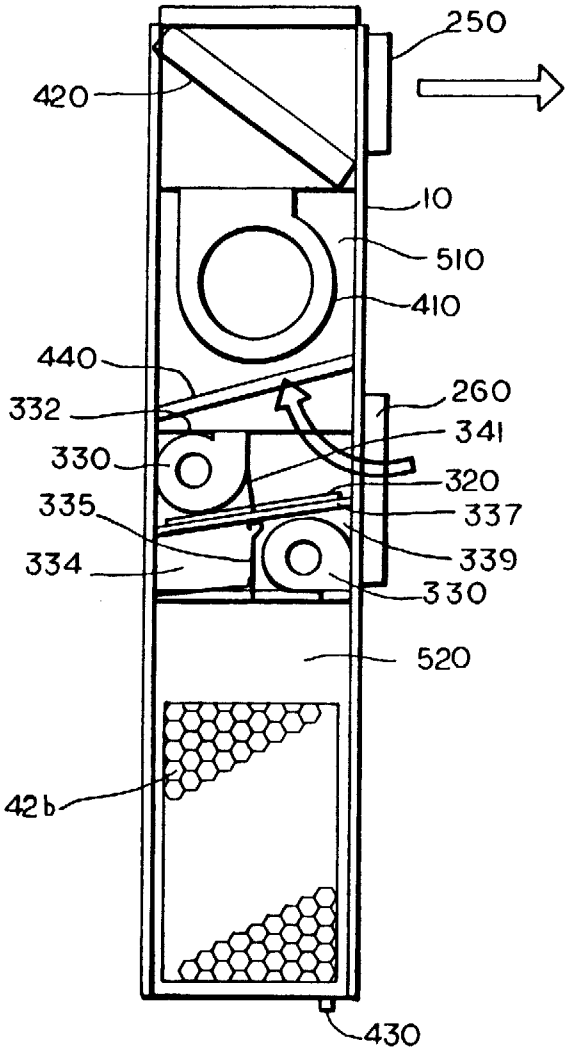
FIG. 23 is a schematic diagram of air flow through the ventilation system with a energy transfer module installed showing system air flow when not in energy transfer mode.

FIG. 23 is a schematic diagram of airflow through air conditioning system 10 with energy transfer module 310 installed operating in recirculation mode, that is, without drawing outside air into the system. No energy transfer is accomplished in this mode of operation as blowers 330 are not activated. Air circulating devices 410 draw return air from the structure through return air opening 260, through filter 440 and into air supply duct 510. The air then circulates past indoor heat exchanger coil 420 and through supply air outlet 250 back into the structure's interior. Plate 341 prevents return air from entering case 322.

Figure 24:
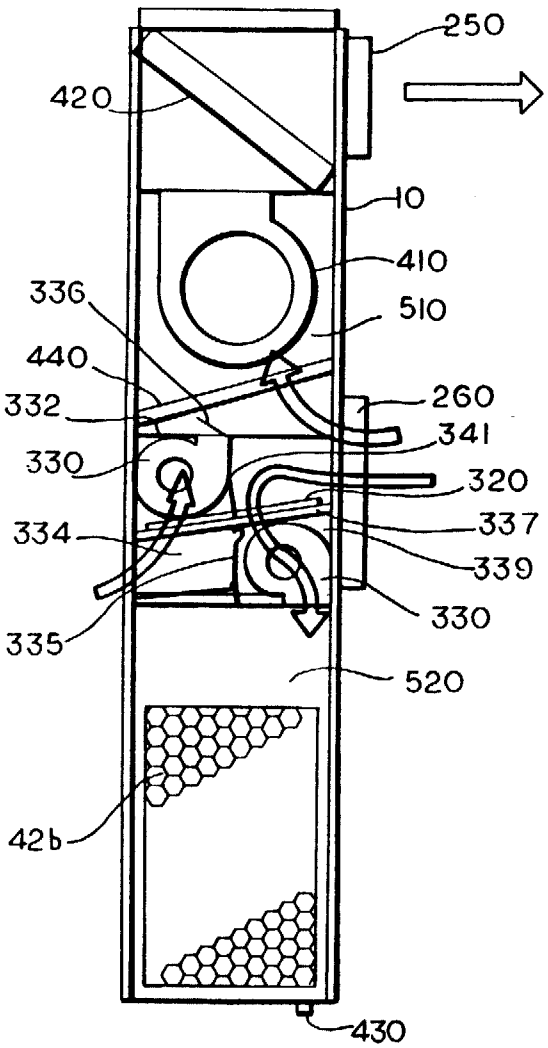
FIG. 24 is a schematic diagram of air flow through the ventilation system with a energy transfer module installed showing system air flow when in energy transfer mode.

FIG. 24 shows schematically airflow through air conditioning system 10 with energy transfer module 310 installed operating in energy transfer mode. Blowers 330 in case 332 draw outdoor air into space 334, past energy transfer disks 320, into blowers 330, and exhaust it into air supply duct 510. Blowers 330 in space 339 draw return air from the interior of the structure through return air opening 260, through energy transfer disks 320, into blowers 330, and out exhaust duct 520. Energy transfer disks 320 rotate through a stream of outdoor air coming into air conditioning system 10 and a stream of return air from the structure. As the energy transfer disks 320 rotate, heat energy from one air stream is absorbed by the energy transfer disks 320 and is transferred to the other air stream, thus providing more efficient and economical energy usage.

The above described energy transfer can be effectively accomplished during both winter and summer ventilation operations. During the winter, part of the warmer interior return air stream passing through return air opening 260 will be drawn through energy transfer disks 320 by blowers 330 in space 339. See FIG. 24. This air stream will thus transfer some heat energy to the energy transfer disks 320. As energy transfer disks 320 rotate, they pass through the cooler outdoor air drawn into air conditioning system 10 from space 334 by blowers 330 in case 332. Heat energy which would have been exhausted absent use of the energy transfer module 310 is thus transferred to the incoming air stream as it passes through energy transfer disks 320.

During summer ventilation operations, part of the cooler interior air stream passing through return air opening 260 will be routed drawn through energy transfer disks 320 by blowers 330 in space 339. This air stream will thus absorb some heat energy from the energy transfer disks 320. As energy transfer disks 320 rotate, they pass through the warmer outdoor air drawn into air conditioning system 10 through space 334 by blowers 330 in case 332. Heat energy in the incoming air stream is transferred to the cooler energy transfer disks 320. By use of the energy transfer module 310, a cooler air stream is provided to air supply duct 510 for cooling by air conditioning system 10. A more economical and energy efficient air conditioning system results from use of the energy transfer module 310.

Figure 25:
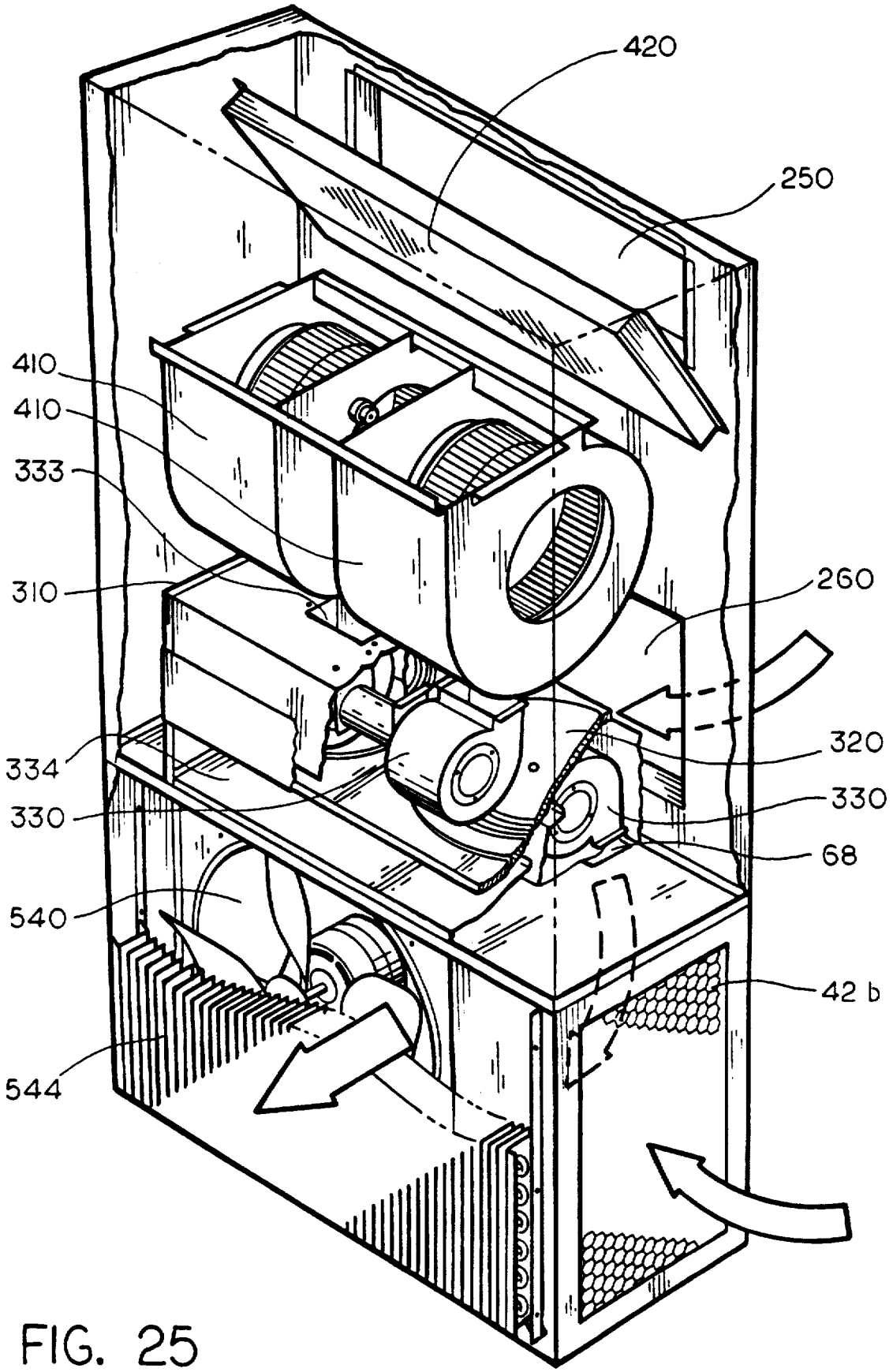
FIG. 25 is a perspective view of the air conditioning system with the outer casing removed showing air flow through the outdoor air exchanger coil.

With the commercial room ventilator module 82, economizer module 62, or the energy transfer module 310 installed in air conditioning system 10, an additional system performance benefit is realized as a result of the exhaust air rout design. See FIG. 25. This benefit is realized as air is exhausted from the applied structure when the air conditioning system 10 is operating in the mechanical cooling or heating mode. "Stand alone" energy recovery devices cannot deliver this benefit, nor would it be realized if the exhaust air is routed in a different manner and not able to pass over the outdoor heat exchanger coil 544.

When air conditioning system 10 is operating in the air cooling mode, cooler exhaust air from the interior of the structure is routed through return air inlet 260, through exhaust opening 68, into exhaust duct 520 and to the inlet of outdoor fan 540. The cooler exhaust air is mixed with warmer outdoor air drawn through perforated metal inlet grill 42*b* and is blown through the outdoor heat exchanger coil 544. This reduces the temperature of the air stream passing through the outdoor heat exchanger coil 544 to a level below the outdoor ambient conditions and increases the air conditioning system 10 cooling capacity while reducing its power consumption.

When air conditioning system 10 operates with a heat pump operating in the heating mode, warmer exhaust air from the interior of the structure is routed through return air inlet 260, through exhaust opening 68, into exhaust duct 520 and to the inlet of outdoor fan 540. The warmer exhaust air is mixed with cooler outdoor air drawn through perforated metal inlet grill **42*b* and is blown through the outdoor heat exchanger coil 544. This increases the temperature of the air stream passing through the outdoor heat exchanger coil 544** to a level above the outdoor ambient conditions thus increasing the system capacity and energy efficiency.

The foregoing is a description of a preferred embodiment of the invention which is given here by way of example only. The invention is not to be taken as limited to any of the specific features as described, but comprehends all variations as come within the scope of the appended claims.

What is claimed is:

1. An air conditioning system attachable to a structure, said structure having an interior and an exterior, said air conditioning system comprising:

a) an elongate housing including;

1) a module receiving chamber inside said housing in communication externally and internally of said housing;

2) a return air opening in said housing in communication with said chamber and with said interior;

3) an air inlet opening in said housing in communication with said chamber and with said exterior;

4) an air exhaust duct in said housing in communication with said chamber and with said exterior for exhausting air from said interior to said exterior;

5) an air supply duct in said housing having a first end in communication with said chamber and a second end in communication with said interior to provide a conduit for passage of conditioned air from said ventilation system to said interior;

6) a ventilation module removably fastenable within said chamber, said ventilation module containing a damper for routing air through said return air opening, said air inlet opening, said air supply duct, and said air exhaust duct;

7) means for conditioning air within said air supply duct;

8) means for circulating air mounted in said air supply duct for drawing fresh air through said air inlet opening and said return air opening, through said chamber, through said air conditioning means, and out said second end of said air supply duct into said interior;

b) means for controlling said air circulating means and said conditioning air means, said control means receiving and processing signals from a thermostat located in said structure or in said return air opening; and c) means for connecting said thermostat with said control means.

2. The air conditioning system of claim 1 wherein said means for conditioning air further comprises a means for filtering air.

3. The air conditioning system of claim 2 wherein said means for conditioning air further comprises a means for air dehumidification.

4. The air conditioning system of claim 3 wherein said means for conditioning air further comprises a means for heating air.

5. The air conditioning system of claim 4 wherein said means for conditioning air comprises a means for cooling air.

6. The air conditioning system of claim 5 wherein said ventilation module further comprises means for permitting said damper to open upon activation of said air circulating means which provides an air pressure differential between a first damper side exposed to said air return duct and a second damper side exposed to said air inlet opening.

7. The air conditioning system of claim 5 wherein said ventilation module further comprises a damper which is controllably moveable by a damper control means to rout fresh air from said exterior of said structure to said air inlet opening through said chamber to said air supply duct, said damper also routing return air from said interior of said structure through said return air opening through said chamber and to said air supply duct.

8. The air conditioning system of claim 7 wherein said damper control means comprises a motor, means for connection attached to said motor and pivotally attached to said damper means, and motor command means for controlling said motor connected with said control means for proportioning fresh air from said exterior with return air from said interior.

9. The air conditioning system of claim 5 wherein said ventilation module further comprises a damper controllably moveable by a damper control means to rout fresh air from said exterior of said structure to said air inlet opening through said chamber to said air supply duct, said damper also routing return air from said interior of said structure through said return air opening through said chamber and to said air supply duct and said exhaust duct.

10. The air conditioning system of claim 9 wherein said damper control means comprises a motor, means for connection attached to said motor and pivotally attached to said damper, and motor command means connected with said control means for proportioning fresh air from said exterior with return air from said interior to said supply air duct, and further routing a portion of return air to said exhaust duct.

11. The air conditioning system of claim 5 wherein said ventilation module further comprises damper controllably moveable by a damper control means to rout fresh air from said exterior of said structure to said air inlet opening through said chamber to said air supply duct, said damper also routing return air from said interior of said structure through said return air opening through said chamber and to said air supply duct and said exhaust duct; said damper being capable of being positioned such that return air from said structure is routed through said return air opening, through said chamber and exclusively to said exhaust duct without passing to said air supply duct; said damper also being capable of being positioned such that return air from said structure is routed through said return air opening, through said chamber exclusively to said air supply duct without passing to said exhaust duct.

12. The air conditioning system of claim 11 wherein said damper control means comprises a motor, means for connection attached to said motor and pivotally attached to said damper, motor command means connected with said control means for controlling the operation of said motor to rout air from said exterior and said interior into said chamber, said exhaust duct, and said air supply duct, and air temperature sensing means connected with said control means to control said damper.

13. The air conditioning system of claim 5 wherein said air conditioning system further comprises an air inlet opening cover plate to prevent air from passing through said air inlet opening when the use of said ventilation module is not required, whereby said ventilation system conditioning air from said return air opening and routing the air through said air supply duct and to said interior.

14. The air conditioning system of claim 5 wherein said ventilation module further comprises means for transferring heat energy between an outside stream of air entering said air conditioning system from said structure's exterior and a return stream of air entering said air conditioning system from said structure's interior.

15. The air conditioning system of claim 14 wherein said ventilation module further comprises means for drawing an outside air stream into said ventilation module and means for routing said outside air stream through said means for transferring heat energy.

16. The air conditioning system of claim 5 and further comprising means for routing exhaust air from said structure past a means for exchanging energy in said air exhaust duct, said means for exchanging energy containing a fluid stream capable of transferring or receiving energy from said exhaust air.

17. An air conditioning system attachable to a structure having an interior and an exterior, said ventilation system comprising:

a) a housing including:
   1) a receiving chamber in communication externally and internally of said housing,
   2) a return air opening in communication with said receiving chamber and said interior,
   3) an air inlet opening in communication with said receiving chamber and said exterior,
   4) an air exhaust duct in communication with said receiving chamber and said exterior for exhausting air from said interior to said exterior,
   5) an air supply duct having a first end in communication with said receiving chamber and a second end in communication with said interior, said air supply duct including a means for conditioning air and means for circulating air which draws air through said air inlet opening, said return air opening, said receiving chamber, said conditioning air means and said second end of said air supply duct to said interior,
   6) an interchangeable ventilation module removably fastened within said receiving chamber having a damper for routing air through said return air opening, said air inlet opening, said air supply duct and said air exhaust duct; and b) a thermostatic control responsive to a temperature variation within said structure for controlling said air circulating means and said air conditioning means.

18. The air conditioning system of claim 17 wherein said means for conditioning air further comprises a means for filtering air, a means for air dehumidification, a means for heating air, and a means for cooling air.

19. The air conditioning system of claim 18 wherein said ventilation module further comprises means for transferring heat energy between an outside stream of air entering said air conditioning system from said structure's exterior and a return stream of air entering said air conditioning system from said structure's interior, means for drawing an outside air stream into said ventilation module, and means for routing said outside air stream through said means for transferring heat energy.

20. The air conditioning system of claim 19 and further comprising means for routing exhaust air from said structure past a means for exchanging energy in said air exhaust duct, said means for exchanging energy containing a fluid stream capable of transferring or receiving energy from said exhaust air.

21. A method for ventilating a structure, said structure having an interior and an exterior, comprising:

a) providing an elongate housing including:
   1) a module receiving chamber inside said housing in communication externally and internally of said housing;
   2) a return air opening in said housing in communication with said chamber and with said interior;
   3) an air inlet opening in said housing in communication with said chamber and said exterior;
   4) an air exhaust duct in said housing in communication with said chamber and with said exterior for exhausting air from said interior to said exterior; and
   5) an air supply duct in said housing having a first end in communication with said chamber and a second end in communication with said interior to provide a conduit for passage of conditioned air from said ventilation system to said interior;

b) fastening a removable ventilation module within said chamber, said ventilation module containing a damper for routing air through said return air opening, said air inlet opening, said air supply duct, and said air exhaust duct;

c) drawing air into said ventilation system by a means for circulating air through said air inlet opening and said return air opening, through said chamber, and into said air supply duct;

d) conditioning said air within said air supply duct by heating, cooling, dehumidifying, and filtering as desired;

e) circulating said conditioned air through said second end of said air supply duct and into said interior of said structure;

f) controlling said air circulating means and said conditioning air means in response to signals received by a thermostat located in said structure; and g) connecting said thermostat with a means for controlling control means.

22. The method of claim 21 and further comprising drawing an outside air stream into said air conditioning system and transferring heat energy between said outside air stream and an air stream drawn from said interior of said structure.

23. The method of claim 22 and further comprising routing exhaust air from said structure past a means for exchanging energy in said air exhaust duct, said means for exchanging energy containing a fluid stream capable of transferring or receiving energy from said exhaust air.

* * * * *